US011518642B2

(12) United States Patent
Shimizu et al.

(10) Patent No.: US 11,518,642 B2
(45) Date of Patent: Dec. 6, 2022

(54) SHEET CRIMP-BINDING DEVICE

(71) Applicants: Tatsuya Shimizu, Yamanashi-ken (JP); Daiju Shimizu, Yamanashi-ken (JP)

(72) Inventors: Tatsuya Shimizu, Yamanashi-ken (JP); Daiju Shimizu, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/467,668

(22) Filed: Sep. 7, 2021

(65) Prior Publication Data

US 2022/0073307 A1 Mar. 10, 2022

(30) Foreign Application Priority Data

Sep. 7, 2020 (JP) ..... JP2020-149773

(51) Int. Cl.

| | |
|---|---|
| ***B65H 31/02*** | (2006.01) |
| ***B65H 37/04*** | (2006.01) |
| ***B31F 5/00*** | (2006.01) |
| ***B31F 5/02*** | (2006.01) |

(52) U.S. Cl.

CPC ..... *B65H 37/04* (2013.01); *B31F 5/001* (2013.01); *B31F 5/02* (2013.01); *B65H 31/02* (2013.01); *B65H 2301/51611* (2013.01); *B65H 2301/51616* (2013.01); *B65H 2801/27* (2013.01)

(58) Field of Classification Search

CPC ..... B31F 1/07; B31F 5/02; B31F 2201/0754; B31F 2201/0779; G03G 15/6544; G03G 2215/00852; B65H 2301/43828; B65H 2301/51616; B65H 2801/27

USPC ..... 270/58.08, 58.09

See application file for complete search history.

(56) References Cited

U.S. PATENT DOCUMENTS

| | | | | |
|---|---|---|---|---|
| 6,188,868 | B1 * | 2/2001 | Shiramura | G03G 15/6541 399/82 |
| 7,201,368 | B2 * | 4/2007 | Tanigami | B42C 1/12 270/58.11 |
| 7,396,008 | B2 * | 7/2008 | Sato | B65H 37/04 270/58.08 |
| 7,410,158 | B2 * | 8/2008 | Iida | B65H 31/24 270/32 |

(Continued)

FOREIGN PATENT DOCUMENTS

JP 2015-020823 A 2/2015

*Primary Examiner* — Leslie A Nicholson, III

(74) *Attorney, Agent, or Firm* — Manabu Kanesaka

(57) ABSTRACT

In a crimp-binding device, a sheet jam less occurs when binding processing is performed. A sheet crimp-binding device includes: a conveying path along which a sheet is conveyed in a predetermined conveying direction; a placing part on which the sheet conveyed along the conveying path is placed; a stack part provided at a location downstream from the placing part in the sheet conveying direction; a discharge unit that discharges the sheet from the placing part to the stack part; a shift unit that moves the sheet placed on a placing position on the placing part in a direction along a sheet surface and perpendicular to the sheet conveying direction; a crimp-binding unit that applies crimp-binding processing to sheets that have been moved in the direction perpendicular to the sheet conveying direction by the shift unit to a crimp-binding position; a recognition unit that recognizes count information of a sheet.

9 Claims, 22 Drawing Sheets

(56) References Cited

U.S. PATENT DOCUMENTS

| | | | | |
|---|---|---|---|---|
| 7,413,177 | B2 * | 8/2008 | Mori | B65H 39/11 271/220 |
| 8,191,885 | B2 * | 6/2012 | Hattori | B65H 31/3081 270/45 |
| 9,334,139 | B2 * | 5/2016 | Hongu | B65H 31/3081 |
| 9,944,488 | B2 * | 4/2018 | Kunieda | B65H 31/02 |
| 10,046,938 | B2 * | 8/2018 | Komiyama | B65H 31/38 |
| 10,496,031 | B2 * | 12/2019 | Sugiyama | B65H 31/10 |
| 10,994,963 | B2 * | 5/2021 | Okada | B65H 31/34 |
| 2007/0176346 | A1 * | 8/2007 | Ochi | G03G 15/50 270/58.09 |

* cited by examiner

Multi-binding

Right corner binding

Left corer binding

Manual binding

Eco-binding

Enlarged view of eco-binding position

Enlarged cross-sectional view taken along line A-A

SHEET CRIMP-BINDING DEVICE

TECHNICAL FIELD

The present invention relates to the improvement of a sheet crimp-binding device that accumulates and aligns sheets on which images have been formed by an image forming device.

BACKGROUND ART

There is generally widely known a post-processing device (finisher) that accumulates and aligns sheets on which images have been formed by an image forming device on a processing tray and binds the sheets. The sheet binding can be performed by, for example, a stapler device that binds sheets with staples and a crimp-binding device that applies pressure to superposed sheets and deforms them for binding.

Patent Document 1 discloses a device that is disposed to be connected to a sheet discharge port of an image forming device and is configured to receive image-formed sheets along a carry-in path, accumulate the sheets in a processing tray, bind the sheets in the processing tray by means of a crimp-binding device, and store the resultant sheet bundle in a downstream side stack tray. The crimp-binding device disclosed in the same document is configured to perform crimp-binding after regulating the sheets that have been fed to the processing tray along a sheet discharge path and accumulated by abutting with the rear end portion thereof in the sheet discharging direction for positioning, aligning the sheet bundle in a sheet width direction, and shifting the sheet bundle in the width direction, and hence reducing misalignment in the sheet bundle.

The crimp-binding device uses a binder mechanism provided with a pair of upper and lower pressurizing surfaces having ridges and grooves, respectively, to pressurize and deform sheets so as to allow the fibers of the sheets to be entangled with each other, whereby the sheets are fixedly bound together. In this device, a high pressurization force is required with a small-sized drive source, such as motor, due to structural constrains, so that the height (frontage) between the pressurizing surfaces of the binder mechanism is set small.

PRIOR ART DOCUMENT

Patent Document

[Patent Document 1] Japanese Patent Application Publication No. 2015-020823

DISCLOSURE OF INVENTION

Problems to be Solved by the Invention

As described above, there is widely known a post-processing mechanism that accumulates, in a bundle form, sheets on which images have been formed by an image forming device and binds them in a post-processing device, and stores the bound sheets in a stack tray. Further, there is known a device (see, for example, Patent Document 1) that crimp-binds a sheet bundle accumulated on a processing tray.

In recent years, along with the improvement of the crimp-binding device, the number of sheets that can be subjected to crimp-binding at a time increases. Thus, when the bundle shift operation disclosed in Patent Document 1 is performed for a sheet bundle composed of many sheets, some sheets may be misaligned with the entire sheet bundle, or a shift function of an alignment member may provide insufficient drive power. Further, as described above, the frontage between the pressurizing surfaces for crimp-binding is small, so that when a thick or swollen sheet bundle is to be inserted into the frontage, some sheets may be caught by the pressurizing surfaces.

To prevent this defect, it is necessary to perform a shift operation of shifting a sheet to a binding position every time the sheet is discharged to the processing tray (every time one sheet is discharged), which is adopted in the stapling processing in Patent Document 1. However, in the case of crimp-binding which can handle a smaller number of sheets than the stapling, the number of sheets that are discharged to the processing tray may exceed the number of sheets that can be handled by the crimp-binding device. Thus, to prevent the occurrence of a jam, the control different from the control of the stapling processing needs to be performed for crimp-binding.

Means for Solving the Problem

To solve the above problem, a sheet crimp-binding device according to the present invention includes: a conveying path along which a sheet is conveyed in a predetermined conveying direction; a placing part on which the sheet conveyed along the conveying path is placed; a stack part provided at a location downstream from the placing part in the sheet conveying direction; a discharge unit that discharges the sheet from the placing part to the stack part; a shift unit that moves the sheet placed on a placing position on the placing part in a direction along a sheet surface and perpendicular to the sheet conveying direction; a crimp-binding unit that applies crimp-binding processing to sheets that have been moved in the direction perpendicular to the sheet conveying direction by the shift unit to a crimp-binding position; a recognition unit that recognizes count information of a sheet to be fed to the placing part; and a control unit configured to, when the recognition unit recognizes the presence of additional succeeding sheets in a state where the number of sheets that are moved to the crimp-binding position every time one sheet is placed on the placing part reaches a predetermined maximum number of bindable sheets, move the sheets that have been moved to the crimp-binding position by the shift unit to the placing position and then discharge them to the stack part by means of the discharge unit and cancel the movement of the succeeding sheets conveyed to the placing part to the crimp-binding position by means of the shift unit.

Advantageous Effect of the Invention

In the present invention, sheets that have been discharged to the processing tray are sequentially shifted to and accumulated at the crimp-binding position. When the number of bindable sheets is exceeded, the shift operation of the sheets to the binding position is cancelled, whereby it is possible to suppress the occurrence of a sheet jam.

BRIEF DESCRIPTION OF DRAWINGS

FIGS. 4A and 4B are explanatory views of a sheet carry-in mechanism of the device of FIG. 2, in which FIG. 4A illustrates a state where a paddle rotating body is at a waiting position and FIG. 4B illustrates a state where the paddle rotating body is at an engaging position;

FIGS. 10A to 10C illustrate states of the stapling unit at binding positions, in which FIG. 10A illustrates a state at a right corner binding position, FIG. 10B illustrates a state at the staple loading position, and FIG. 10C illustrates a state at a manual binding position;

FIGS. 11A to 11D are explanatory views of a sheet bundle carry-out mechanism in the device of FIG. 2, in which FIG. 11A illustrates a waiting state, FIG. 11B illustrates a relay conveyance state, FIG. 11C illustrates the structure of a second conveying member, and FIG. 11D illustrates a state of discharging a sheet to a stack tray;

FIGS. 15A and 15B are explanatory views of a paper guide mechanism of the device of FIG. 2, in which FIG. 15A illustrates a retracted state of the guide, and FIG. 15B illustrates an engaged state of the guide;

MODE FOR CARRYING OUT THE INVENTION

In this specification, "offset conveyance of a sheet bundle" refers to moving (widthwise moving) a sheet bundle carried in through a sheet discharge port in a direction perpendicular to (or intersecting with) a sheet conveying direction, and "offset amount" refers to a movement amount thereof. Further, "alignment of a sheet bundle" refers to aligning sheets having different sizes carried in through the sheet discharge port in accordance with reference (in center reference or side reference). Thus, "offset after sheet alignment" refers to moving the whole sheets in a direction perpendicular to the sheet conveying direction after the sheets having different sizes are aligned to the reference.

Hereinafter, the present invention will be described in detail based on illustrated preferred embodiments. The present invention relates to a sheet bundle binding mechanism for binding an accumulated and aligned sheet bundle with images formed thereon by an image forming system to be described later. An image forming system illustrated in FIG. 1 includes an image forming unit A, an image reading unit C, and a post-processing unit B. A document image is read by the image reading unit C. Based on the read image data, the image forming unit A forms an image on a sheet. Then, the post-processing unit B (sheet bundle binding device; the same applies the following) aligns, accumulates, and binds the image-formed sheets and stores the bound sheet bundle on a stack tray 25 located on the downstream side.

The post-processing unit B to be described later is incorporated, as a unit, in a sheet discharge space (stack tray space) 15 formed in a device housing of the image forming unit A. The post-processing unit B has an inner finisher structure having a post-processing mechanism that performs binding processing after the image-formed sheets conveyed to a sheet discharge port 16 are aligned and accumulated on a processing tray and then stores the sheets on the stack tray 25 located on the downstream side. Not limited to the above, the present invention may have a configuration in which the image forming unit A, the image reading unit C, and the post-processing unit B are independently arranged each as a stand-alone unit and are connected through network cables to be systematized.

Sheet-Bundle Binding Device (Post-Processing Unit)

Figure 2:
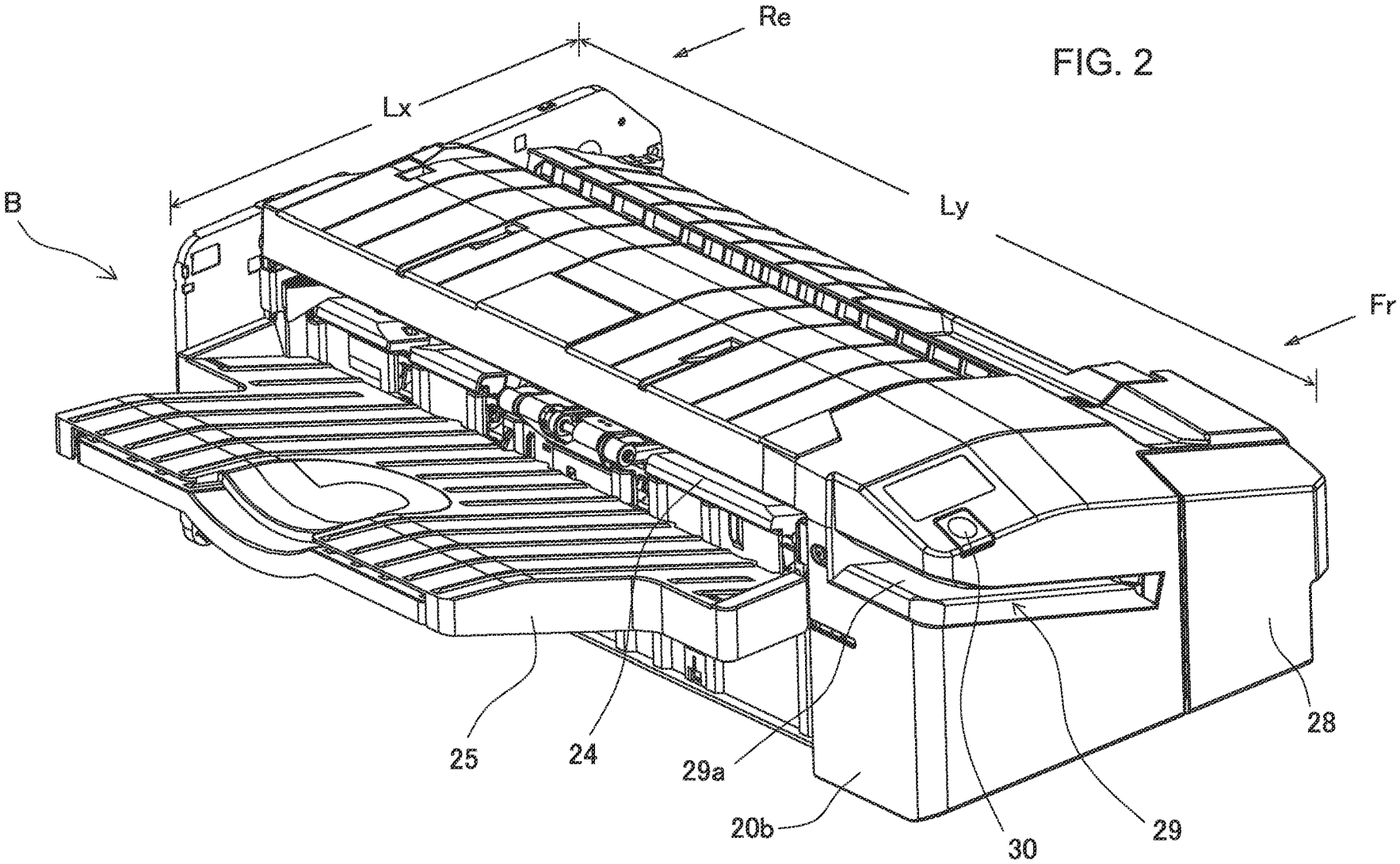
FIG. 2 is an explanatory perspective view illustrating the entire configuration of a post-processing device in the image forming system of FIG. 1.
Figure 3:
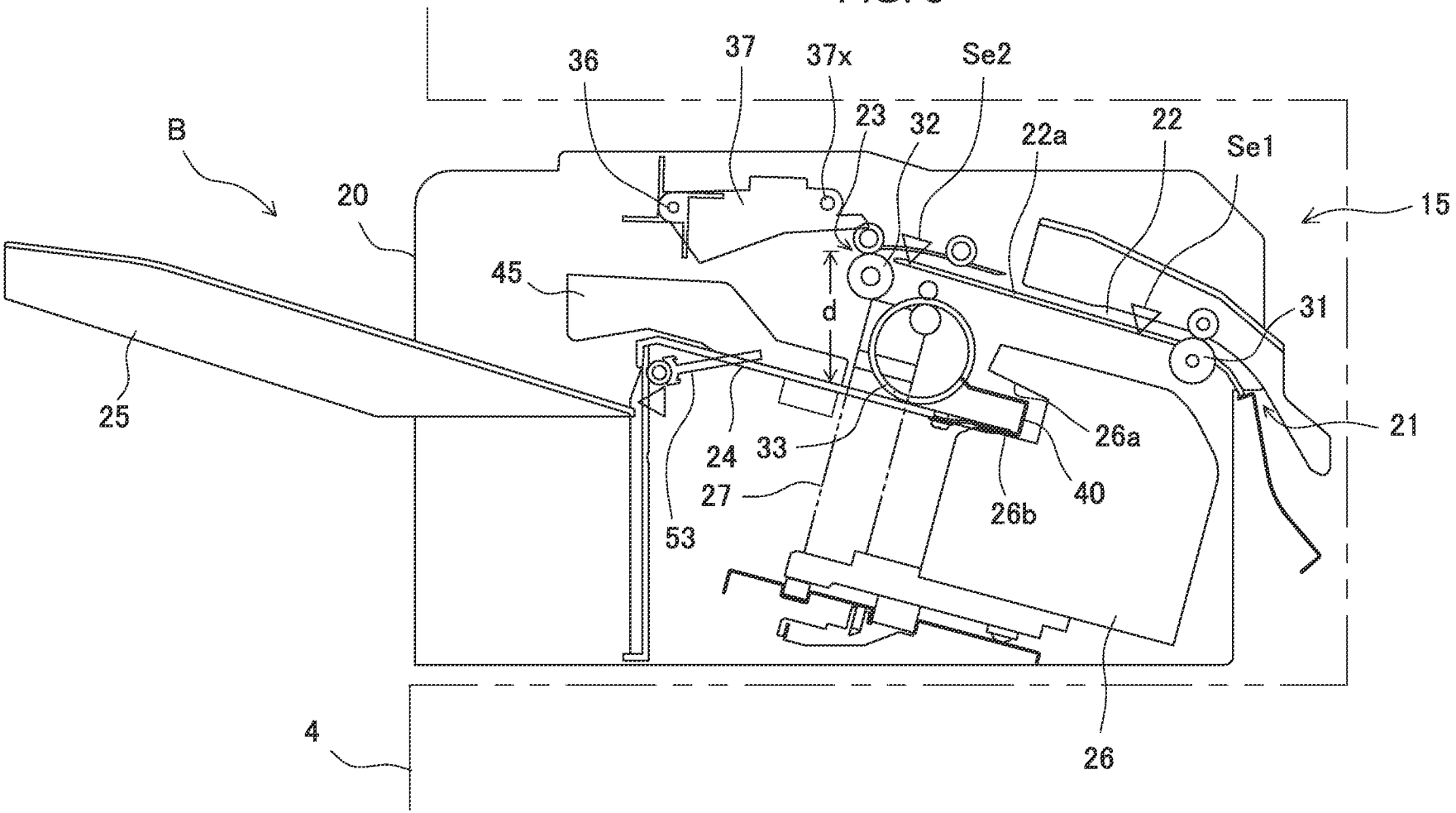
FIG. 3 is a cross-sectional side view (device front side) of the device of FIG. 2.
Figure 4A:
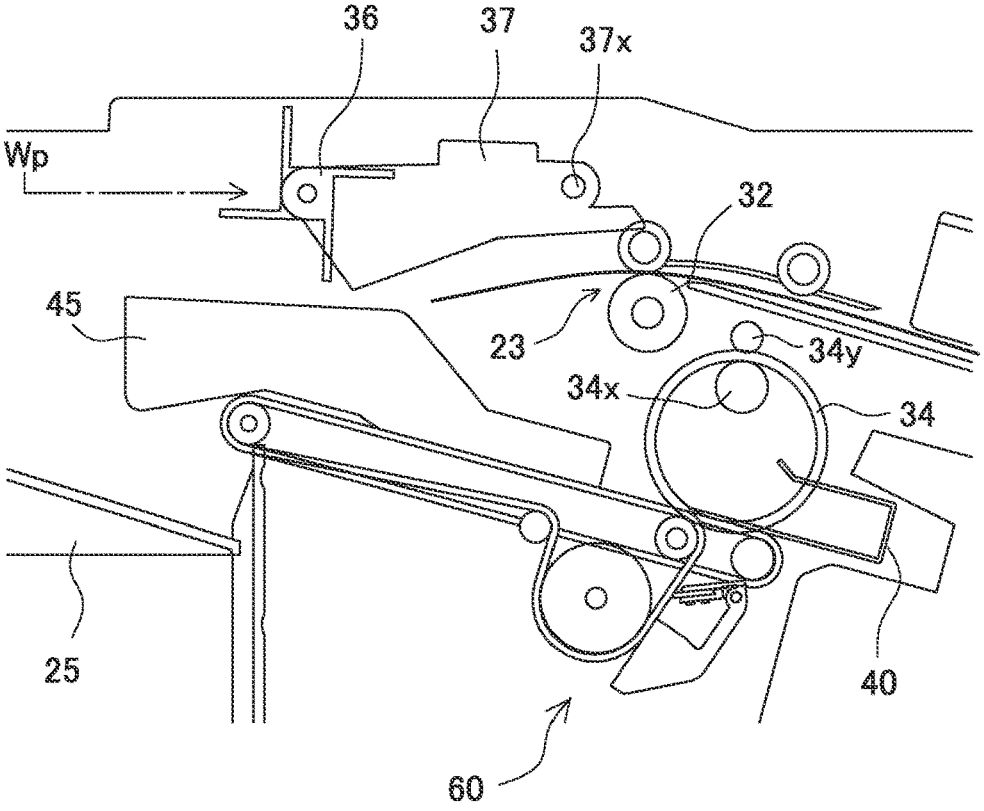
Figure 4B:
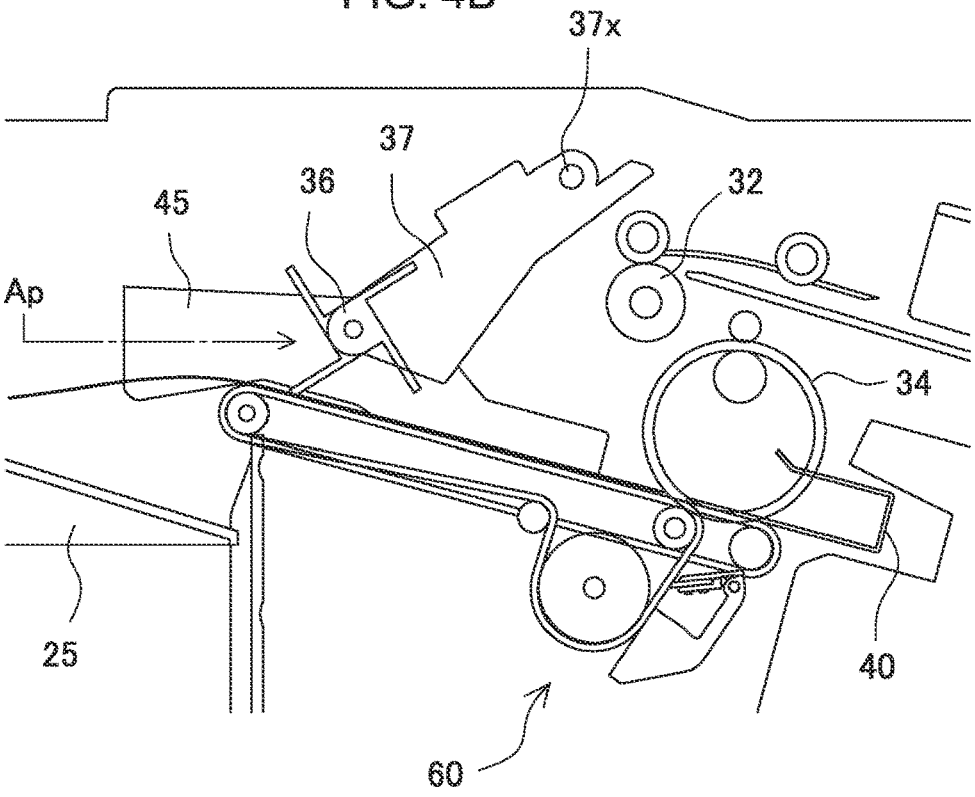

As illustrated in FIGS. 2 and 3 being a perspective view and a cross-sectional view, respectively, of the post-processing unit B, the post-processing unit B includes a device housing 20, a sheet carry-in path 22 arranged in the device housing 20, a processing tray 24 disposed downstream from a sheet discharge port 23 of the sheet carry-in path 22, and a stack tray 25 disposed downstream from the processing tray 24.

The processing tray 24 is provided with a sheet carry-in unit 35 for carrying in a sheet, and a sheet regulating unit 40 and an aligning unit 45 for accumulating carried-in sheets in a bundle. The processing tray 24 is further provided with a stapling unit 26 (first binding unit) for the staple-binding of a sheet bundle and a stapleless binding unit 27 (second binding unit) for the stapleless binding of a sheet bundle. Each component will be described below in detail.

Device Housing

The device housing 20 includes a device frame 20*a* and an external casing 20*b*. The device frame 20*a* has a frame structure to support mechanisms (a path mechanism, a tray mechanism, a conveying mechanism, and the like) to be described later. In the illustrated example, a binding mechanism, a conveying mechanism, a tray mechanism, and a drive mechanism are arranged at a pair of left and right-side frames (not illustrated) facing each other to form a monocoque structure integrated with the external casing 20*b*. The external casing 20*b* has the monocoque structure obtained by integrating, with mold processing using resin or the like, right and left side frames 20*c*, 20*d* and a stay frame (bottom frame 20*e* to be described later) that connects the side frames 20*c*, 20*d*, and a part (device front side) thereof is exposed to be operable from the outside.

That is, the device housing 20 is incorporated in the sheet discharge space 15 of the image forming unit A to be described later with an outer circumference thereof covered with the external casing 20*b*. In this state, the front side of the external casing 20*b* is exposed to be operable from the outside. A cartridge mount opening 28 for staples, a manual feed setting part 29, and a manual operation button 30 (in the illustrated example, a switch having a built-in display lamp) to be described later are arranged on the front side of the external casing 20*b*.

The external casing 20*b* has a length Lx in a sheet discharging direction and a length Ly in a direction perpendicular to the sheet discharging direction which are set based on the maximum sheet size and set smaller than the lengths of the sheet discharge space 15 of the image forming unit A described later.

Sheet Carry-In Path (Sheet Discharge Path)

As illustrated in FIG. 3, the sheet carry-in path 22 (hereinafter, referred to as "sheet discharge path") having a carry-in port 21 and a sheet discharge port 23 is provided in the above-mentioned device housing 20. In the illustrated example, the sheet discharge path 22 is configured to receive a sheet in the horizontal direction and discharge the sheet from the discharge port 23 after conveying in substantially the horizontal direction. The sheet discharge path 22 is formed by an appropriate paper guide (plate) 22*a* and incorporates a feeder mechanism for conveying a sheet. The feeder mechanism is constituted by conveying roller pairs arranged at predetermined intervals in accordance with a path length. In the illustrated example, a carry-in roller pair 31 is disposed in the vicinity of the carry-in port 21, and a sheet discharge roller pair 32 is disposed in the vicinity of the discharge port 23. A sheet sensor Se1 for detecting a sheet front end and/or a sheet rear end is disposed in the sheet discharge path 22.

The sheet discharge path 22 is formed by a linear path extending in substantially the horizontal direction so as to traverse the device housing 20. This is to prevent stress from being applied to a sheet due to a curved path. Accordingly, the sheet discharge path 22 is formed as having linearity which is allowed by unit layout. The carry-in roller pair 31 and the sheet discharge roller pair 32 are connected to the same drive motor M1 (hereinafter, referred to as "conveying motor") and convey a sheet at the same circumferential speed.

Processing Tray

As illustrated in FIG. 3, the processing tray 24 is disposed at the sheet discharge port 23 of the sheet discharge path 22 with a level difference d formed downstream relative to the sheet discharge port 23. The processing tray 24 is provided with a sheet placing surface 24*a* that supports at least a part of a sheet so as to vertically accumulate sheets fed from the sheet discharge port 23 in a bundle. In the illustrated example, a structure (bridge support structure) is adopted, in which the sheet front end side is supported by the stack tray 25 to be described later, and the sheet rear end side is supported by the processing tray 24. This reduces the size of the tray.

The above processing tray 24 accumulates sheets fed from the sheet discharge port 23 in a bundle, binds the accumulated sheet after aligning the sheets to a predetermined posture, and carries out the bound sheet bundle to the stack tray 25 located on the downstream side. To this end, the processing tray 24 incorporates therein a "sheet carry-in mechanism 35", a "sheet aligning mechanism 45", a "binding mechanisms 26 and 27", and a "sheet bundle carry-out mechanism 60"

Sheet Carry-In Mechanism (Sheet Carry-In Unit)

The processing tray 24 is disposed at the sheet discharge port 23 with the level difference d formed therebetween. In order for the sheets to be smoothly conveyed onto the processing tray 24 in a proper posture, the sheet carry-in unit 35 is required. The illustrated sheet carry-in unit 35 (friction rotating body) is constituted by an elevation paddle rotating body 36. At the stage when the rear end of a sheet is carried out from the sheet discharge port 23 onto the tray, the paddle rotating body 36 is rotated to convey the sheet in a direction (direction from the left to right in FIG. 3) opposite to the sheet discharging direction to make the sheet abut against the sheet end regulating unit 40 to be described later for alignment (positioning).

To this end, the sheet discharge port 23 is provided with an elevation arm 37 axially supported to the device frame 20*a* at a support shaft 37*x* so as to be swingable, and the paddle rotating body 36 is rotatably axially supported to the leading end of the elevation arm 37. The support shaft 37*x* has a not-shown pulley which is connected with the above-mentioned conveying motor M1.

Further, the elevation arm 37 is connected with an elevation motor M3 (hereinafter, referred to as "paddle elevation motor") through a spring clutch (torque limiter) and is elevated/lowered between an upper waiting position Wp and a lower actuation position (engagement position with a sheet) Ap by rotation of the paddle elevation motor M3. That is, the spring clutch elevates the elevation arm 37 from the actuation position Ap to the waiting position Wp by one direction rotation of the paddle elevation motor M3, and the elevation arm 37 waits at the waiting position Wp after abutting against a not-shown locking stopper. On the other hand, the spring clutch is relaxed by the opposite-direction rotation of the paddle elevation motor M3, causing the elevation arm 37 to be lowered by its own weight from the waiting position Wp to the lower actuation position Ap and then to be engaged with the uppermost sheet of the sheets accumulated on the processing tray 24.

Figure 5:
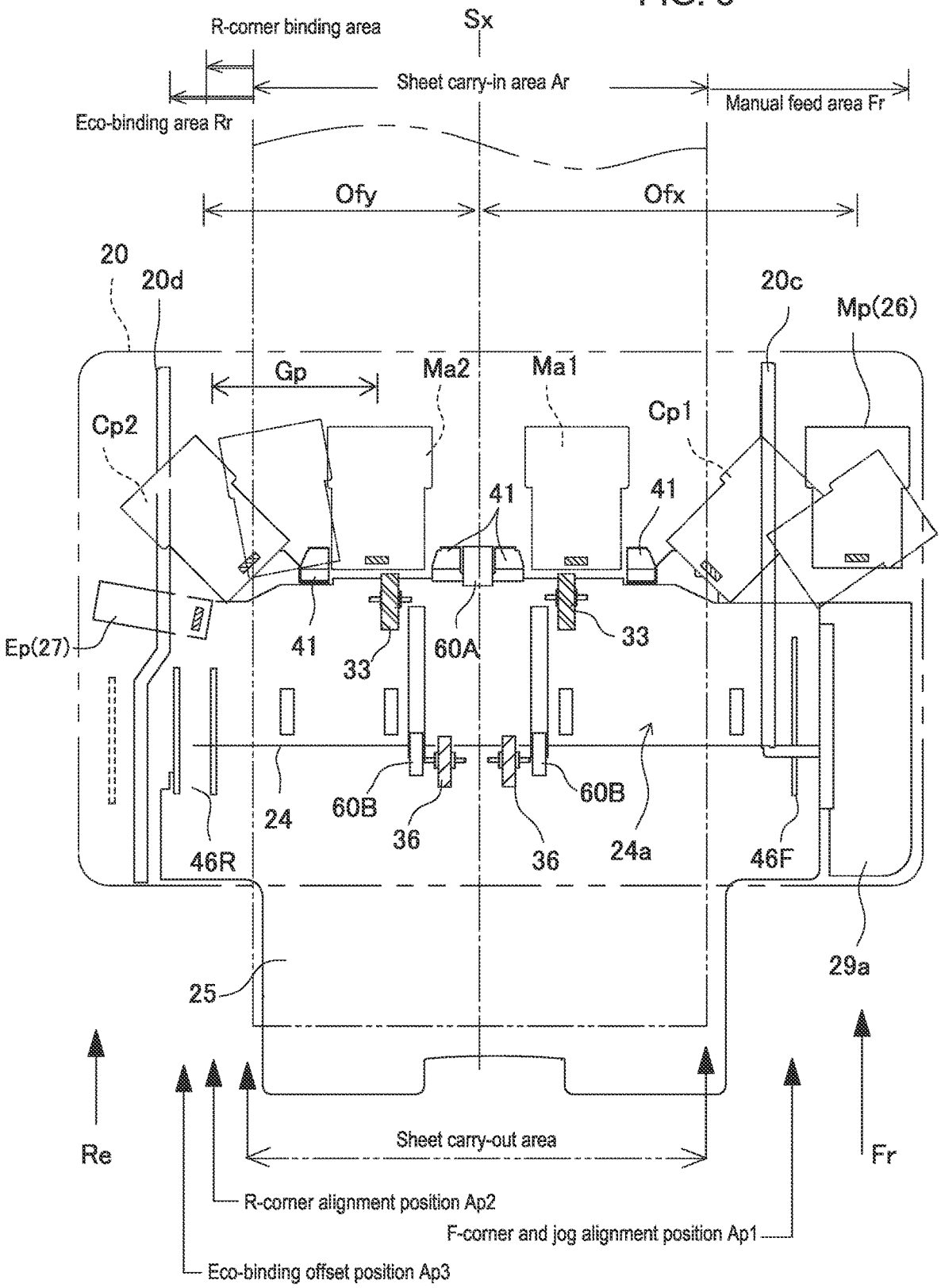
FIG. 5 is an explanatory view illustrating the arrangement of individual areas and alignment positions in the device of FIG. 2.

In the example of FIG. 5, a pair of paddle rotating bodies 36 are disposed symmetrically with respect to a sheet center (center reference Sx) and spaced apart from each other at a predetermined distance. Alternatively, three paddle rotating bodies may be disposed at the sheet center and both sides thereof, or only one paddle rotating body may be disposed at the sheet center.

The above paddle rotating body 36 is constituted by a flexible rotating body such as a rubber-like plate member or a plastic blade member. In addition to the paddle rotating member, a rotating member, such as a roller body or a belt body, whose surface has adequate friction may be used to constitute the sheet carry-in unit 35. Further, in the above example, the paddle rotating body 36 is lowered from the upper waiting position Wp to the lower actuation position Ap after the sheet rear end is carried out from the sheet discharge port 23; however, the following elevation mechanism may be adopted.

In an elevation mechanism different from that illustrated, for example, at the stage when the sheet front end is carried out from the sheet discharge port 23, a friction rotating body is lowered from the waiting position to the actuation position and, at the same time, the friction rotating body is rotated in the sheet discharging direction and, then, at the timing when the sheet rear end is carried out from the sheet discharge port 23, the friction rotating body is rotated in the direction opposite to the sheet discharging direction. With this configuration, it is possible to convey the sheet carried out from the sheet discharge port 23 to a predetermined position on the processing tray 24 at high speed and without skew.

Raking Rotating Body (Raking Conveying Unit)

When a sheet is conveyed to a predetermined position on the processing tray 24 by the sheet carry-in mechanism 35 (paddle rotating body) disposed at the sheet discharge port 23, a raking conveying unit 33 is required to guide the front end of the sheet (in particular, the front end of a curled or skewed sheet) to the regulating stopper 40 located on the downstream side.

In the illustrated example, a raking rotating body (raking conveying unit) 33 that conveys the uppermost sheet of sheets stacked on the upstream side of the sheet end regulating stopper 40 to be described later toward the sheet end regulating member side is disposed below the sheet discharge roller pair 32. The raking rotating body 33 includes a ring-shaped belt member 34 (hereinafter, referred to as "raking belt") which is disposed above the top end part of the processing tray 24. The raking belt 34 is engaged with the uppermost sheet of the sheets stacked on the sheet placing surface 24*a* and rotates in such a direction as to convey the sheet to the regulating member side.

The raking belt 34 is constituted by a high-friction belt member (roulette belt or the like) formed of a flexible material such as rubber and is supported so as to be held between a rotary shaft 34*x* connected to a drive motor (the one illustrated is the conveying motor M1) and an idle shaft 34*y*. The raking belt 34 is imparted with a torque in the counterclockwise direction depicted in FIG. 3 from the rotary shaft 34*x*. The raking belt 34 makes the front end of a sheet carried in along the uppermost sheet of the sheets stacked on the processing tray 24 abut against the regulating stopper 40 on the downstream side while pressing the carried-in sheet.

The raking belt 34 is configured to be elevated/lowered above the uppermost sheet of the sheets stacked on the processing tray 24 by a belt shift motor M5 (hereinafter, referred to as "roulette elevation motor") (description of the elevation mechanism is omitted). The raking belt 34 is lowered at the timing when the sheet front end enters between the belt surface and the uppermost sheet to be engaged with the carried-in sheet. Further, when conveying a sheet bundle from the processing tray 24 to the stack tray 25 located on the downstream side using a sheet bundle carry-out unit 60 to be described later, the roulette elevation motor M5 is controlled such that the raking belt 34 is separated from the uppermost sheet and waits thereabove.

Sheet Aligning Mechanism

The processing tray 24 is provided with a sheet aligning mechanism 45 that positions a carried-in sheet to a predetermined position (processing position). The illustrated sheet aligning mechanism 45 includes the "sheet end regulating unit 40" for regulating the position of the end surface (front end surface or rear end surface) in the sheet conveying direction of a sheet carried out from the sheet discharge port 23 and the "side aligning unit 45" for aligning (width-aligning) a sheet in a direction (sheet side direction) perpendicular to the sheet discharging direction. Hereinafter, the sheet end regulating unit 40 and the side aligning unit 45 will be described in this order.

Sheet End Regulating Unit

The illustrated sheet end regulating unit 40 is constituted by a rear end regulating member 41 for abutment-regulating the rear end of a sheet in the sheet discharging direction. The rear end regulating member 41 has a regulating surface 41*a* for abutment-regulating the rear end edge of a sheet in the sheet discharging direction carried in along the sheet placing surface 24*a* of the processing tray 24. The rear end edge of the sheet in the sheet discharging direction conveyed by the above raking conveying unit 33 abuts against the regulating surface 41*a* and is stopped.

When multi-binding is performed with a stapling unit 26 to be described later, the stapling unit 26 is moved along a sheet rear end (in a direction perpendicular to the sheet discharging direction). To prevent obstruction against movement of the stapling unit 26, the rear end regulating member 41 is configured to adopt any one of the following structures:

(1) a mechanism in which the rear end regulating member proceeds to and retracts from a movement path (motion trajectory) of the binding unit, (2) a mechanism in which the rear end regulating member is moved integrally with the binding unit, and (3) forming the rear end regulating member, for example, as a channel-shaped folded piece disposed inside a binding space which is formed by a head and an anvil of the binding unit.

In the illustrated example, the rear end regulating member 41 is constituted by a plate-like bent member having a U-shape (channel shape) in cross section and disposed in the binding space of the stapling unit 26. With the minimum size sheet as a reference, a first member 41A is disposed at the sheet center, and second and third members 41B and 41C are disposed on both sides of the first member 41A so as to be spaced apart therefrom (see FIG. 5). This allows the stapling unit 26 to be moved in the sheet width direction.

Figure 7:
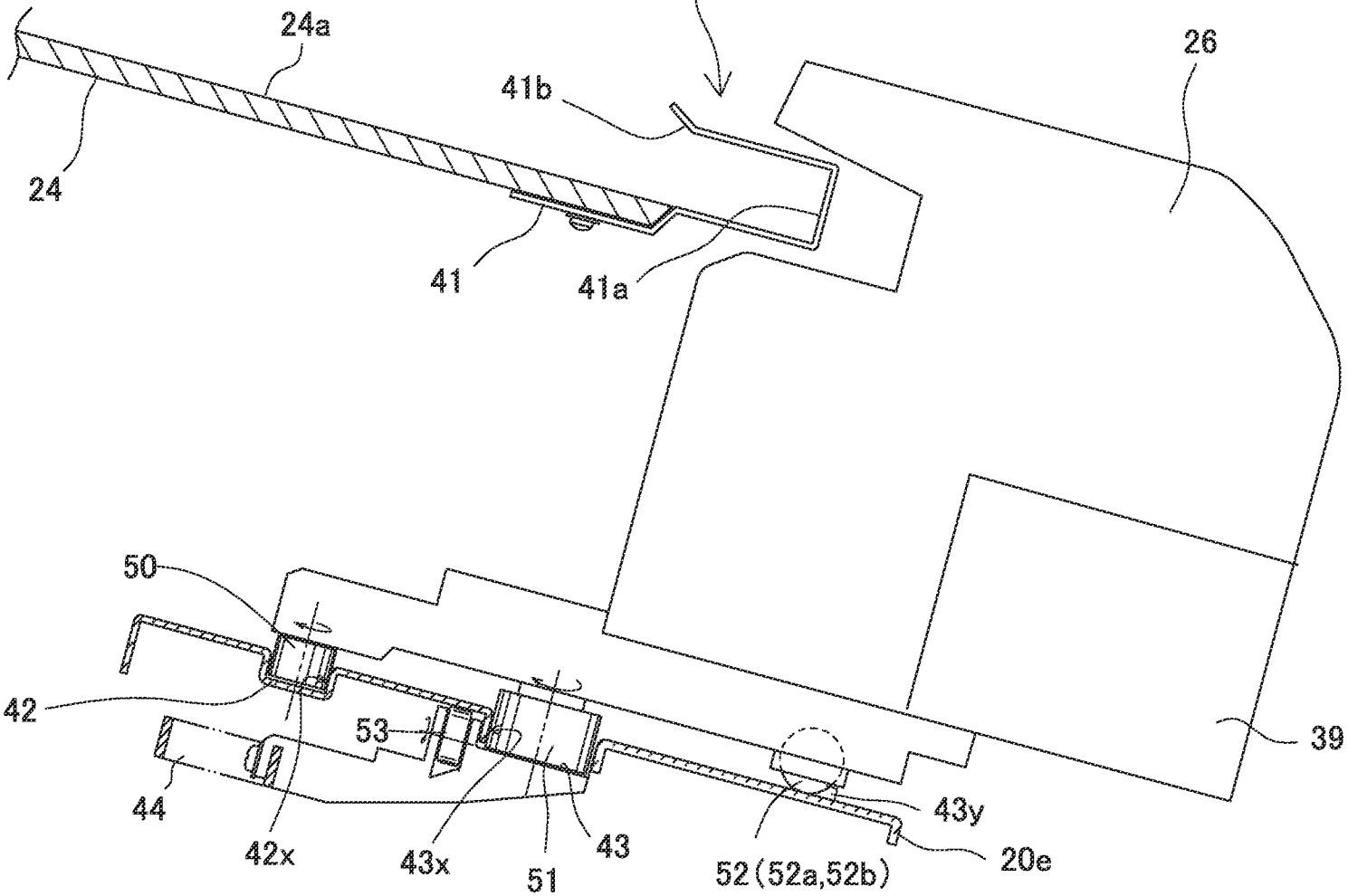
FIG. 7 is an explanatory view of a moving mechanism of a stapling unit.

As illustrated in FIGS. 5 and 7, a plurality of the rear end regulating members 41 formed of channel-shaped folded pieces are fixed to the processing tray 24 with leading end parts thereof fixed to a back surface wall of the processing tray 24 with screws. The regulating surface 41*a* is formed at each of the rear end regulating members 41 and an inclined surface 41*b* for guiding a sheet end to the regulating surface 41*a* is continuously formed at the leading end part of the folding thereof.

Side Aligning Unit

The processing tray 24 is provided with the aligning unit 45 (hereinafter, referred to as "side aligning member") for positioning a sheet abutting against the above rear end regulating member 41 in a direction ("sheet width direction") perpendicular to the sheet discharging direction.

The side aligning member 45 differs in its configuration depending on whether sheets of different sizes laid on the processing tray 24 are aligned with reference to the sheet center or its one side. In the example of FIG. 5, sheets of different sizes are discharged from the sheet discharge port 23 with reference to the center, and the sheets are aligned on the processing tray 24 with reference to the center. Then, the sheets aligned in a bundle with reference to the center are subjected to binding. In the case of multi-binding, the sheet bundle is set at the position aligned with reference to the center, and binding is applied to binding positions Ma1 and Ma2 by the stapling unit 26. In the case of corner binding in which binding is applied, the sheet bundle is offset to one side in the sheet width direction by a predetermined distance, and binding is applied to binding positions Cp1 and Cp1 by the stapling unit 26.

To perform the above aligning operation, the aligning unit 45 is provided with a pair of side aligning members 46 (46F, 46R) each protruding upward from the sheet placing surface 24*a* of the processing tray 24 and each having a regulating surface 46*x* engaged with the side edge of a sheet. The side aligning members 46F and 46R are disposed opposite to each other and configured to reciprocate in a predetermined stroke on the processing tray 24. The stroke amount is set based on the difference in size between a maximum size sheet and a minimum size sheet and the amount of offset movement of the aligned sheet bundle to either side in the sheet width direction. That is, the stroke amount of each of the side aligning members 46F and 46R is set based on the movement amount for aligning sheets of different sizes and the movement amount for offsetting an aligned sheet bundle.

Figure 6:
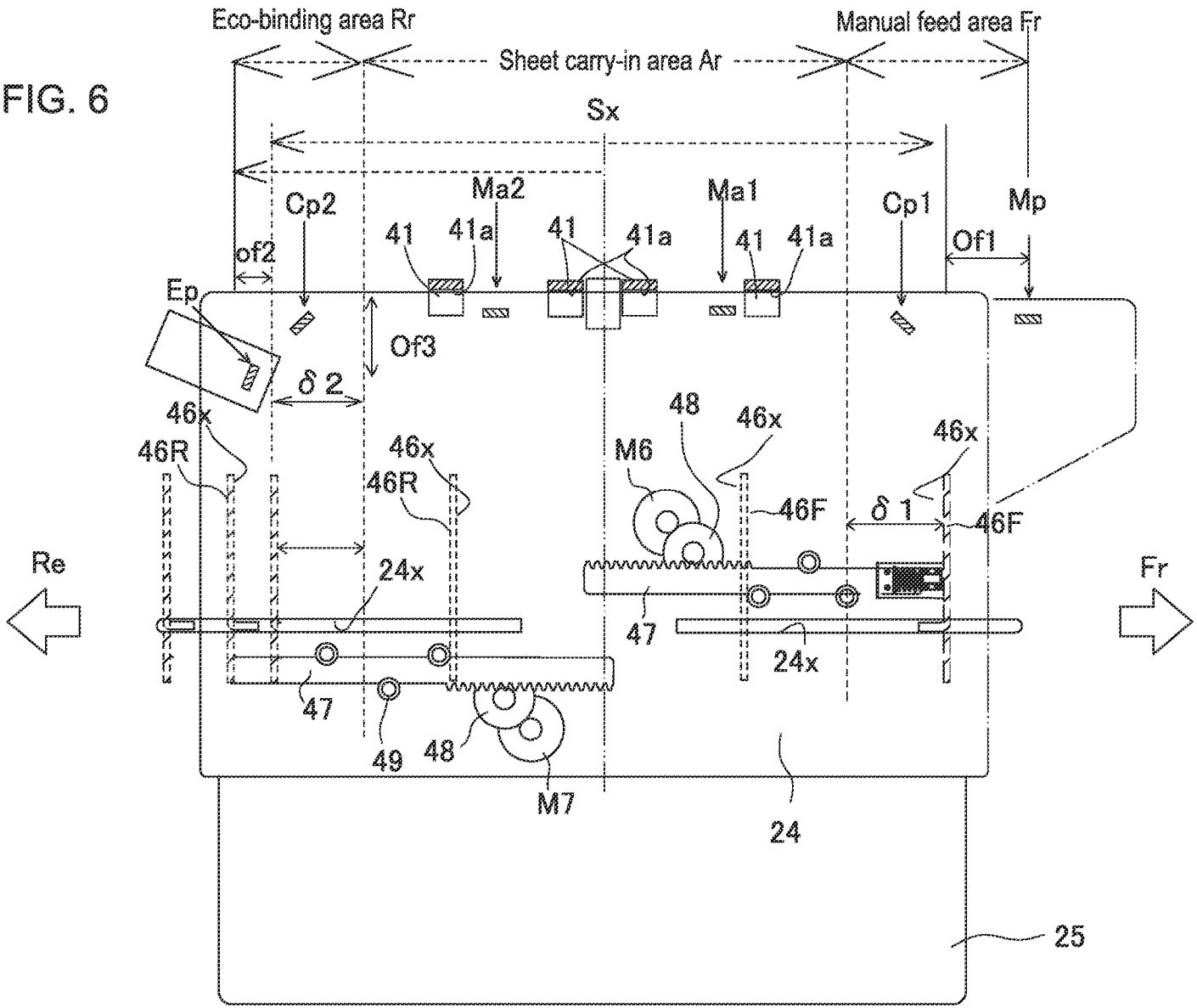
FIG. 6 is an explanatory view of the configuration of a side aligning unit in the device of FIG. 2.

Thus, as illustrated in FIG. 6, the side aligning member 46 includes a right-side aligning member 46F (on the device front side) and a left side aligning member 46R (on the device rear side). The side aligning members 46F and 46R are supported on the tray member such that the regulating surfaces 46*x* thereof abutting against the end edges of a sheet are moved in a mutually closing or separating direction. Slit grooves 24*x* penetrating the processing tray 24 vertically are formed in the processing tray 24. The side aligning members 46F and 46R having the regulating surfaces 46*x* are fitted in the slit grooves 24*x* so as to be slidable on the tray upper surface.

Each of the side aligning members 46F and 46R is integrally formed with a rack 47 and is slidably supported by a plurality of guide rollers 49 (or rail members) on the back surface side of the processing tray 24. Aligning motors M6 and M7 are connected to the left and right racks 47 respectively through a pinion 48. The left and right aligning motors M6 and M7 are each constituted by a stepping motor. Positions of the left and right-side aligning members 46F and 46R are detected by position sensors (not illustrated). Based on the detected values, the side aligning members 46F and 46R can be moved respectively in either left or right direction by specified movement amounts.

In place of the illustrated rack-and-pinion mechanism, a configuration may be adopted, in which the side aligning members 46F and 46R are each fixed to a timing belt, and the timing belt is connected, through a pulley, to a motor for reciprocating the belt laterally.

According to the above configuration, a controller 75 causes the left and right-side aligning members 46 at predetermined waiting positions (distanced by a sheet width+α therebetween) based on sheet size information provided from the image forming unit A or the like. In this state, a sheet is carried in onto the processing tray 24. At the timing when the end of the sheet abuts against the sheet end regulating member 41, aligning operation is started. In the aligning operation, the left and right aligning motors M6 and M7 are rotated in opposite directions (closing directions) by the same amount. Accordingly, the sheets carried in onto the processing tray 24 are positioned and stacked in a bundle form in reference to the sheet center. With the repetition of the carry-in operation and aligning operation, sheets are aligned and stacked on the processing tray 24 in a bundle form. At this time, sheets of different sizes are positioned in center reference.

The sheets thus accumulated on the processing tray 24 in center reference can be subjected to binding processing at a plurality of positions at regular intervals (i.e., multi-binding processing) in the above posture at the rear end (or front end) of the sheets. In a case of performing the binding processing on a sheet corner, one of the left and right-side aligning members 46F and 46R is moved to and stopped at a position where a sheet side end is matched with a specified binding position. Then, the side aligning member on the opposite side is moved in the direction approaching the other side aligning member. A movement amount in the approaching direction is calculated in accordance with a sheet size. Accordingly, a sheet carried in onto the processing tray 24 is aligned such that a right-side end is matched with a binding position in a case of right corner binding and a left side end is matched with a binding position in a case of left corner binding.

When "stapleless binding processing" to be described later is performed on the sheet corner, the side aligning member 46R at the unit rear side is moved and stopped at a position where the side end of a sheet discharged in center reference is matched with a specified binding position. Then, at the timing when the sheet is carried in on the processing tray 24, the side aligning member 46F is moved in the direction approaching the side aligning member 46R. With the above procedure, the sheets discharged on the processing tray 24 are moved one by one to a stapleless binding position.

The left and right-side aligning members 46F and 46R and the aligning motors M6 and M7 are each provided with a position sensor (not illustrated) such as a position sensor and an encode sensor for detecting the position thereof. Owing to that the aligning motors M6 and M7 are constituted by stepping motors, home positions of the side aligning members 46F and 46R are detected by position sensors (not illustrated), and the motors are PWM-controlled, so that the left and right-side aligning members 46F and 46R can be controlled with a relatively simple control configuration.

Sheet Bundle Carry-Out Mechanism

The following describes a sheet bundle carry-out mechanism (sheet bundle carry-out unit 60) illustrated in FIG. 11. The processing tray 24 is provided with a sheet bundle carry-out mechanism that carries out a sheet bundle bound by the first binding unit 26 or second binding unit 27 to the stack tray 25 located on the downstream side. On the processing tray 24 described based on FIG. 5, the first sheet rear end regulating member 41A is arranged at the sheet center Sx, and the second and third sheet rear end regulating members 41B and 41C are arranged bilaterally as being distanced therefrom. A sheet bundle stopped by the regulating member 41 is to be carried out to the stack tray 25 located on the downstream side after being subjected to binding processing by the binding unit 26 (27).

To achieve the above operation, the sheet bundle carry-out unit 60 is disposed along the sheet placing surface 24*a* of the processing tray 24. The illustrated sheet bundle carry-out unit 60 includes a first conveying member 60A and a second conveying member 60B. Conveyance in a first zone L1 on the processing tray 24 is performed by the first conveying member 60A and conveyance in a second zone L2 is performed by the second conveying member 60B, whereby relay conveyance is performed. Since a sheet bundle is conveyed serially by the first and second conveying members 60A and 60B, mechanisms of the first and second conveying members 60A and 60B can be made different. It is required that the member that conveys a sheet bundle from a starting point being approximately the same as that of the sheet rear end regulating unit 40 is formed of a less swaying member (elongated support member) and a member that causes the sheet bundle to drop at the end point of conveyance is downsized (for travelling on a loop trajectory).

The first conveying member 60A is constituted by a first carry-out member 61 formed of a folded piece having a channel shape in cross section. The first carry-out member 61 includes a stop surface 61*a* that stops a rear end surface of a sheet bundle and a sheet surface pressing member 62 (an elastic film member; Mylar piece) that presses an upper surface of the sheet bundle stopped by the stop surface 61*a*. As illustrated, the first conveying member 60A is formed of a folded piece having a channel shape in cross section. Accordingly, when being fixed to a carrier member 65*a* (belt) to be described later, the first conveying member 60A moves (feeds) the rear end of the sheet bundle in the sheet conveying direction while travelling integrally with the belt with less swaying. The first conveying member 60A reciprocates with a stroke Str1 on an approximately linear trajectory without travelling on a loop trajectory curved as described later.

The second conveying member 60B is constituted by a second carry-out member 63 having a pawl shape. The second carry-out member 63 includes a stopper surface 63*a* that stops the rear end surface of a sheet bundle and a sheet surface pressing member 64 that presses the upper surface of the sheet bundle. The sheet surface pressing member 64 is axially swingably supported by the second carry-out member 63 and has a sheet surface pressing surface 64*a*. The sheet surface pressing surface 64*a* is biased by a biasing spring 64*b* so as to press the upper surface of the sheet bundle.

Figure 10B:
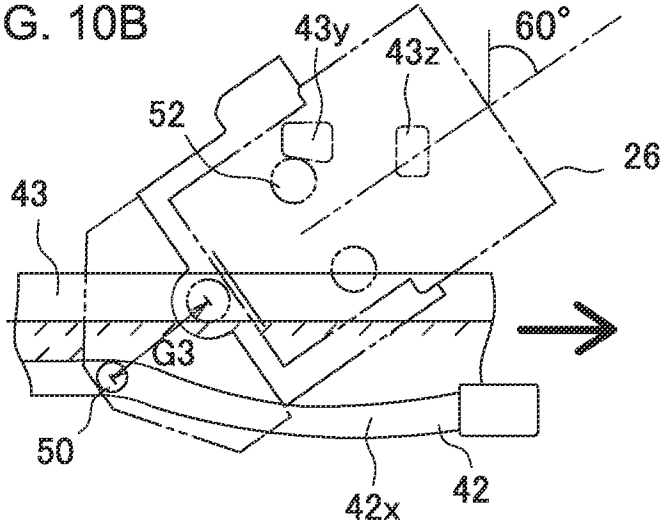
Figure 10C:
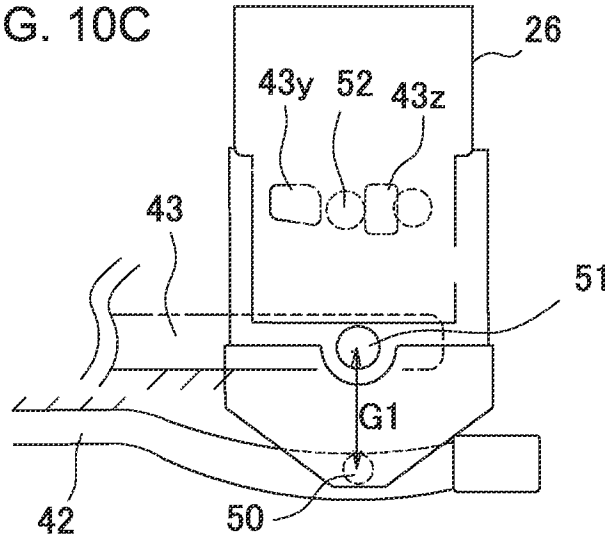

The sheet surface pressing surface 64*a* is constituted by an inclined surface inclined with respect to the traveling direction as illustrated. Accordingly, when the second conveying member 60B is moved in a direction of the arrow shown in FIG. 10B, so that the sheet surface pressing surface 64*a* is engaged with the sheet rear end at a nipping angle γ. At this time, the sheet surface pressing surface 64*a* is deformed upward (counterclockwise in the same drawing) in the arrow direction against the biasing spring 64*b*. Then, as illustrated in FIG. 10C, the sheet surface pressing surface 64*a* presses the upper surface of the sheet bundle toward the sheet placing surface 24*a* by the action of the biasing spring 64*b*.

The above-configured first carry-out member 61 reciprocates with the first carrier member 65*a* and the second carry-out member 63 reciprocates with a second carrier member 65*b* between a base end part and an exit end part of the sheet placing surface 24*a*. To this end, the sheet placing surface 24*a* is provided with driving pulleys 66*a*, 66*b* and a driven pulley 66*c* which are spaced apart from each other by a conveyance stroke. Reference numerals 66*d* and 66*e* are each an idling pulley.

The first carrier member 65*a* (toothed belt in the drawings) is installed between the driving pulley 66*a* and the driven pulley 66*c*, and the second carrier member 65*b* (toothed belt) is installed between the driving pulley 66*b* and the driven pulley 66*c* through the idling pulleys 66*d*, 66*e*. A drive motor M4 is connected to the driving pulleys 66*a*, 66*b*. The first driving pulley 66*a* is formed to have a small diameter and the second driving pulley 66*b* is formed to have a large diameter so that rotation of the drive motor M4 is transmitted to the first carrier member 65*a* at a low speed and to the second carrier member 65*b* at a high speed.

That is, the first conveying member 60A and the second conveying member 60B are connected in common to the drive motor M4 through a decelerating mechanism (belt pulleys, gear coupling, or the like) so as to travel respectively at a low speed and a high speed. In addition, a cam mechanism is incorporated in the second driving pulley 66*b* to delay the drive transmission. This is, as described later, because of difference between the movement stroke Str1 of the first conveying member 60A and the movement stroke Str2 of the second conveying member 60B and positional adjustment of waiting positions of the respective members.

With the above configuration, the first conveying member 60A reciprocates on a linear trajectory with the first stroke Str1 from the rear end regulation position of the processing tray 24, and the first zone Tr1 is set within the first stroke Str1. The second conveying member 60B reciprocates on a semi-loop trajectory with the second stroke Str2 from the first zone Tr1 to the exit end of the processing tray 24, and the second zone Tr2 is set within the second stroke Str2.

The first conveying member 60A is moved downstream from the sheet rear end regulation position (moved from FIG. 11A to FIG. 11B) at a speed V1 with rotation in one direction of the drive motor M4 to convey the sheet bundle while pushing the rear end thereof with the stop surface 61*a*. Being delayed by a predetermined period of time from the first conveying member 60A, the second conveying member 60B projects above the sheet placing surface 24*a* from the waiting position (FIG. 11A) on the back surface side of the processing tray 24 and is moved in the same direction at a speed V2 following the first conveying member 60A. Since the speed V2 is set to be higher than the speed V1, the sheet bundle on the processing tray 24 is relayed from the first conveying member 60A to the second conveying member 60B.

Figure 11A:
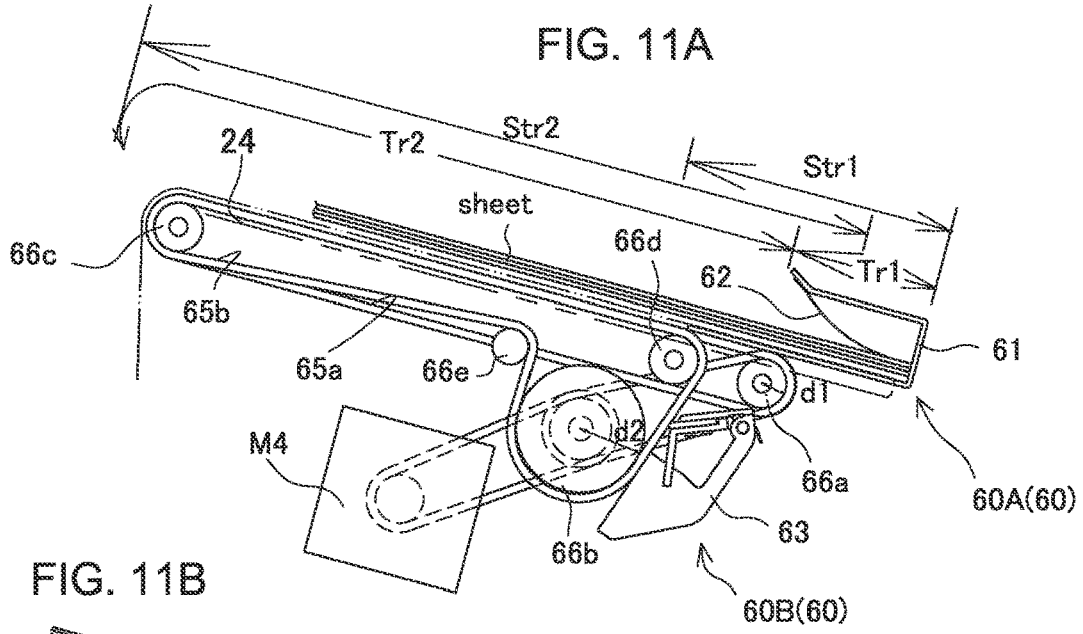
Figure 11B:
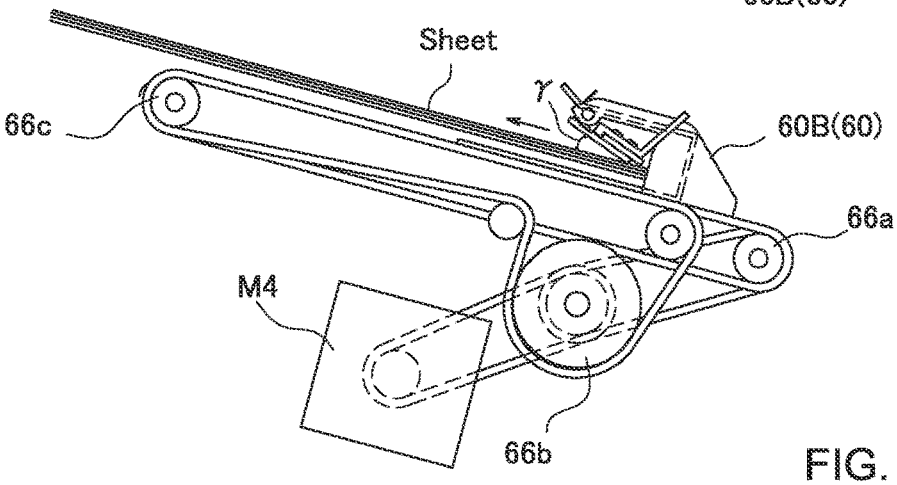
Figure 11C:
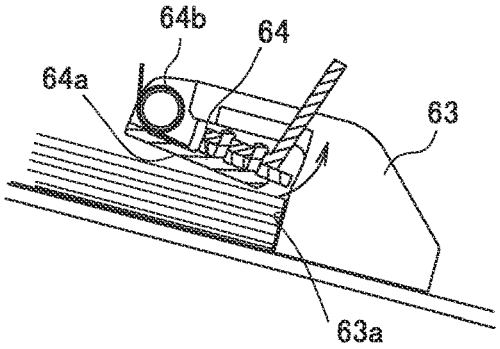
Figure 11D:
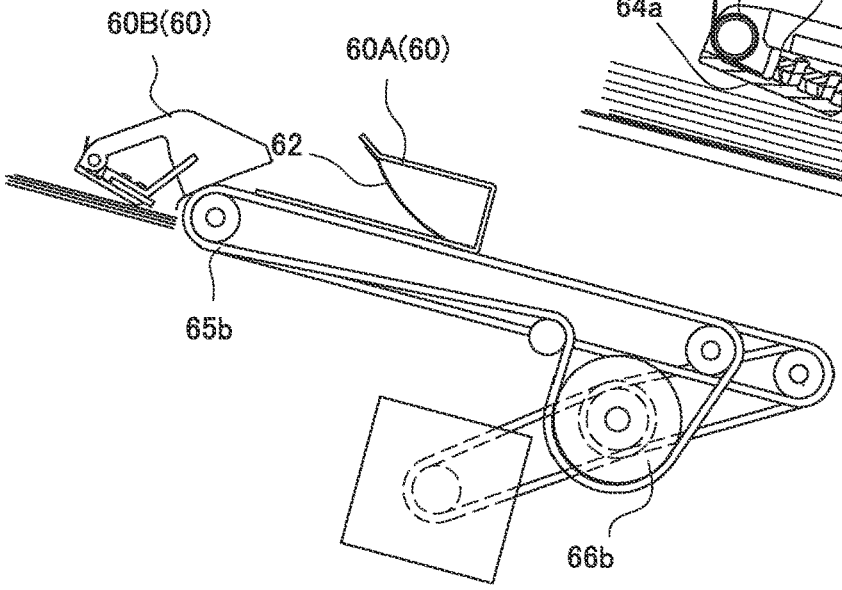

FIG. 11B illustrates a state of the relay conveyance. The second conveying member 60B travelling at the speed V2 catches up with the sheet bundle travelling at the speed V1. That is, after passing through the first zone Tr1, the second conveying member 60B catches up with the first conveying member 60A and performs conveyance to the downstream side in the second zone Tr2 while being engaged with the rear end surface of the sheet bundle.

When the second conveying member 60B abuts, at the relay point at a high speed, against the sheet bundle travelling at the speed V1, the sheet bundle is discharged toward the stack tray 25 while the rear end of the sheet bundle is held as being nipped between the sheet surface pressing member 64 and the carrier member (belt) 65*a* (65*b*) with the upper surface of the sheet bundle pressed by the sheet surface pressing surface 64*a*.

Method of Binding Process (Binding Position)

As described above, sheets conveyed to the carry-in port 21 of the sheet discharge path 22 are positioned in an aligned and accumulated state on the processing tray 24 by the sheet end regulating member 40 and the side aligning members 46 at the previously set location and in the previously set posture. Then, binding processing is performed on the sheet bundle, and the resultant sheet bundle is carried out to the stack tray 25 located on the downstream side. In the following, a method of the binding processing in this case will described.

In the illustrated example, the processing tray 24 is provided with the "first binding unit 26 for the staple-binding of a sheet bundle" and the "second binding unit 27 for the stapleless binding of a sheet bundle". The controller 75 to be described later performs the binding of a sheet bundle using a selected one of the first and second binding units 26 and 27 and discharges the bound sheet bundle downward. This is a first feature of the binding method. Using a staple for binding allows bookbinding to make it difficult for the bound sheets to come off the bundle; however, such convenience that the bound sheets are easily separated from the sheet bundle may be required for some uses. Further, when a used sheet bundle is to be shredded, the metal staple needs to be removed before the shredding. Thus, it is preferable for a user to be able to select one from "staple binding" and "stapleless binding".

Further, in addition to a series of post-processing operations including the sheet carry-in from the sheet carry-in path (sheet discharge path) 22, alignment/accumulation, and binding, it is possible to bind a sheet bundle (hereinafter, referred to as "manual stapling processing") formed outside the image forming device (outside the system of the present invention). This is a second feature of the binding method.

To this end, a manual feed setting part 29 having a manual feed setting surface 29*a* on which the sheet bundle from outside is set is formed in the external casing 20*b*, and the above-mentioned stapling unit 26 is configured to be moved from a sheet carry-in area Ar of the processing tray 24 to a manual feed area Fr.

Based on FIGS. 8, 9, and 10A to 10C, the binding methods will be individually described. There are defined in this device "multi-binding positions Ma1 and Ma2" where sheets are staple-bound at a plurality of positions, "corner binding positions Cp1 and Cp2" where sheets are bound at a corner, "a manual binding position Mp" where binding processing is performed on manually set sheets, and "a stapleless binding position Ep" where sheets are bound at a corner without using a staple. In the following, positional relation among the respective binding positions will be described.

Figure 8:
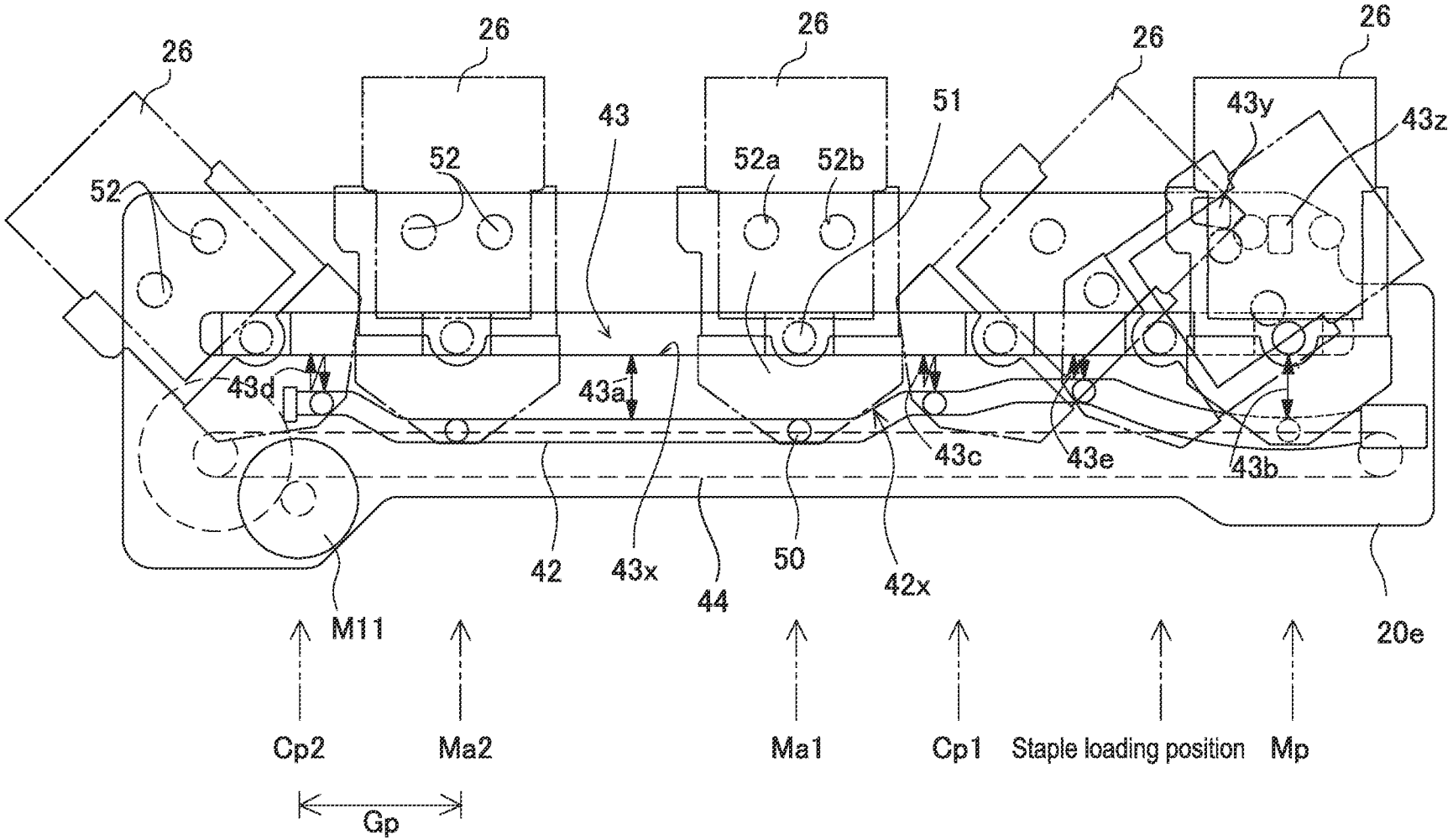
FIG. 8 is an explanatory view illustrating binding positions of the stapling unit.

Based on FIG. 8, the binding methods will be individually described. There are defined in this device "multi-binding positions Ma1 and Ma2" where sheets are staple-bound at a plurality of positions, "corner binding positions Cp1 and Cp2" where sheets are bound at a corner, "a manual binding position Mp" where binding processing is performed on manually set sheets, and "a stapleless binding position Ep" where sheets are bound at a corner without using a staple. In the following, positional relation among the respective binding positions will be described.

Multi-Binding

Figure 12A:
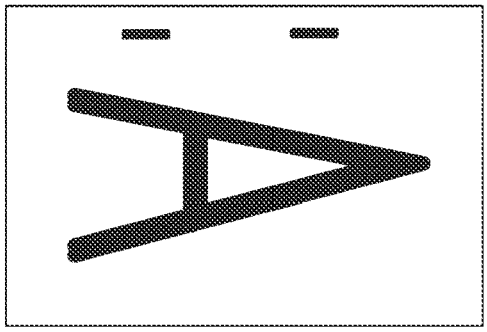
FIGS. 12A to 12G illustrate a binding method of a sheet bundle.

As illustrated in FIG. 5, in the multi-binding processing, a sheet bundle (hereinafter, referred to as "aligned sheet bundle") positioned on the processing tray 24 by the sheet end regulating member 41 and the side aligning members 46 is bound at the end edge (rear end edge in the drawing). The multi-binding positions Ma1 and Ma2 where binding processing is performed on two distanced positions is defined in FIG. 9. The stapling unit 26 to be described later is moved from a home position to the binding position Ma1 and the binding position Ma2 sequentially in this order and performs binding processing at the binding positions Ma1 and Ma2. Not limited to two positions, the binding processing may be performed at three or more positions as the multi-binding positions Ma. FIG. 12A illustrates a multi-bound state.

Corner Binding

Figure 12B:
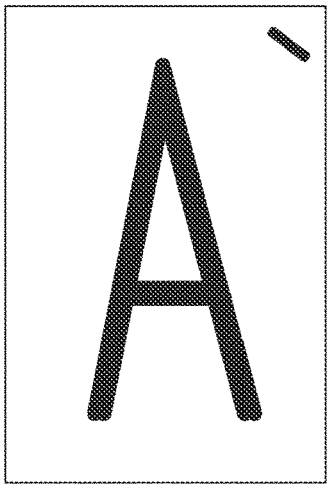
Figure 12C:
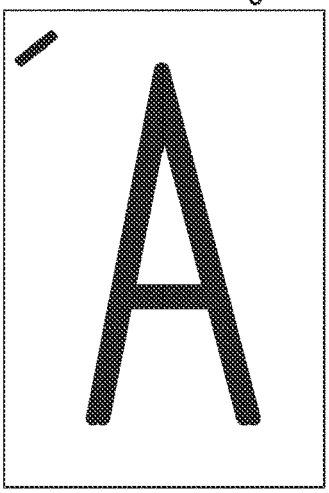

For the corner binding processing, there are defined binding positions as two bilateral positions being a right corner binding position Cp1 where binding processing is performed on the right corner on an aligned sheet bundle stacked on the processing tray 24 and a left corner binding position Cp2 where binding processing is performed on the left corner of an aligned sheet bundle. In this case, the binding processing is performed with a staple being oblique by a predetermined angle (between about 30° and about 60°). The stapling unit 26 to be described later is mounted on the unit frame with the entire unit being oblique by the predetermined angle thereat. FIGS. 12B and 12C illustrate corner-bound states, respectively.

FIGS. 12B and 12C illustrate a case where the binding processing is performed on either the right corner or left corner of a sheet bundle by selection and a staple is set oblique by the predetermined angle. Not limited to the above, even in a case where binding is performed on only one of the left and right corners, it is also possible to adopt a structure that the binding is performed with a staple being parallel to a sheet end edge without being oblique.

Manual Binding

Figure 12D:
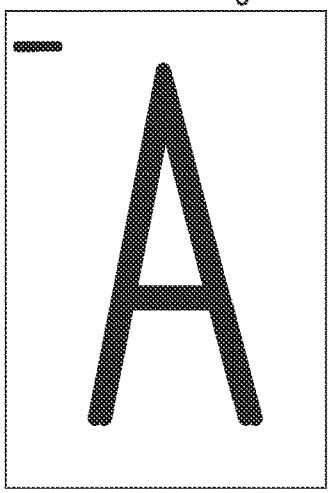
Figure 12E:
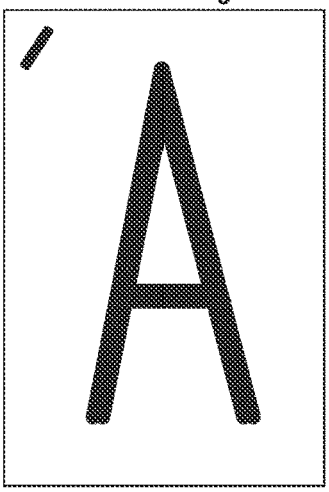
Figure 12F:
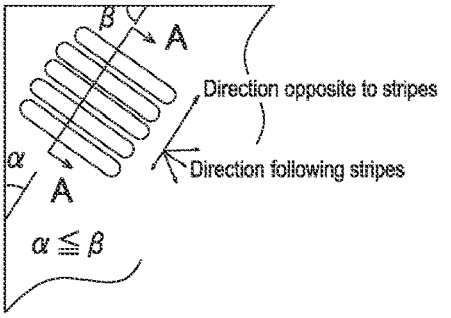
Figure 12G:
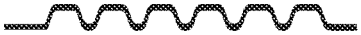

The manual binding position Mp is set on the manual feed setting surface 29*a* formed in the external casing 20*b* (a part of the device housing). The manual feed setting surface 29*a* is disposed adjacently in parallel to the sheet placing surface 24*a* through the side frame 20*c* at a height position substantially flush with the sheet placing surface 24*a* of the processing tray 24. In the illustrated example, both the sheet placing surface 24*a* of the processing tray 24 and the manual feed setting surface 29*a* support a sheet in a substantially horizontal posture and at substantially the same height. FIG. 12D illustrates a manual-bound state.

That is, in FIG. 5, the manual feed setting surface 29*a* and the sheet placing surface 24*a* are disposed on the right-side and left side, respectively, with the side frame 20*c* as the boundary. The manual binding position Mp is set on the same line as the above-mentioned multi-binding position Ma disposed on the sheet placing surface 24*a*. This is for allowing both the multi-binding and manual binding to be performed by the same stapling unit 26. Thus, there are set, on the processing tray 24, the sheet carry-in area Ar, manual feed area Fr (device front side), and stapleless binding (eco-binding) area Rr (device rear side).

Stapleless Binding Position (Eco-Binding Position)

The stapleless binding position Ep (hereinafter, referred to as "eco-binding position") is defined so that binding processing is performed on a side edge part (corner part) of sheets as illustrated in FIG. 5. The illustrated eco-binding position Ep is defined at a position where the binding processing is performed on one position at the side edge part of a sheet bundle in the sheet discharging direction. Then, the binding processing is performed as being oblique to sheets by a predetermined angle. The eco-binding position Ep is defined in the eco-binding area Rr which is distanced to the device rear side from the sheet carry-in area Ar of the processing tray 24. In the present embodiment, at the stapleless binding position Ep, a waiting position at sheet binding and a binding position at the sheet binding are set at the same position; however, at sheet binding, the eco-binding unit 27 may be moved to the placing side of a sheet bundle. In short, it is possible to bind a sheet bundle moved as a bundle as long as the eco-binding position Ep is positioned outside the sheet carry-in area.

Mutual Relation Among Binding Positions

The multi-binding positions Ma1 and Ma2 are defined in the sheet carry-in area Ar (inside thereof) where sheets are carried in onto the processing tray 24 from the sheet discharge port 23. Each of the corner binding positions Cp1 and CP2 is defined outside the sheet carry-in area Ar at a reference position which is apart rightward or leftward (side alignment reference) at a predetermined distance from the sheet discharge reference Sx (center reference). As illustrated in FIG. 6, at the outer side from a side edge of a maximum sized sheet to be bound, the right corner binding position Cp1 is defined at a position deviated rightward from one side edge of the sheet by a predetermined amount (δ1) and the left corner binding position Cp2 is defined at a position deviated leftward from the other side edge of the sheet by a predetermined amount (δ2). The deviation amounts are set to be the same (δ1=δ2).

The multi-binding positions Ma1, Ma2 and manual binding position Mp are defined approximately on the same straight line. Further, the corner binding positions Cp1, Cp2 are defined at positions each having an oblique angle (e.g., 45°) to be bilaterally symmetric with respect to the sheet discharge reference Sx.

The manual binding position Mp is defined in the manual feed area Fr in the device front side and outside the sheet carry-in area Ar. The eco-binding position Ep is defined in the eco-binding area Rr at the device rear side Re and outside the sheet carry-in area Ar.

Further, the manual binding position Mp is defined at a position which is offset by a predetermined amount (Of1) from the right corner binding position Cp1 of the processing tray 24. The eco-binding position Ep is defined at a position which is offset by a predetermined amount (Of2) from the left corner binding position Cp2 of the processing tray 24. Thus, the multi-binding positions Ma are defined based on the sheet discharging reference (center reference) of the processing tray 24 to which sheets are carried in, and the corner binding positions Cp1 and Cp2 are defined based on the maximum sheet size. Further, the manual binding position Mp is defined at the position which is offset by the predetermined amount (Of1) from the right corner binding position Cp1 to the device front side. Similarly, the eco-binding position Ep is defined at the position which is offset by the predetermined amount (Of2) from the left corner binding position Cp2 to the device rear side. According to the above, arrangement can be made in an orderly manner without causing interference of sheet movement.

The sheet movement in each binding processing will now be described. In the multi-binding processing, sheets are carried in onto the processing tray 24 in center reference (or side reference) and aligned in this state, and then subjected to the binding processing. After the binding processing, the sheets are discharged downstream in the above posture. In the corner binding processing, sheets are aligned at the alignment position on a specified side and subjected to the binding processing. After the binding process is performed, the sheets are discharged downstream in the above posture. In the eco-binding processing, sheets carried in onto the processing tray 24 are offset by the predetermined amount Of2 to the device rear side every time one sheet is carried in and then subjected to the binding processing.

Further, in the manual binding, an operator sets sheets on the manual feed setting surface 29*a* distanced by the predetermined amount Of1 from the alignment reference which is positioned at the front side from the processing tray 24. This allows a plurality of the binding operations to be performed while sheet setting positions therefor are defined in the direction perpendicular to the sheet conveying direction. Therefore, sheet jamming can be suppressed keeping high processing speed.

In the eco-binding process, the controller 75 to be described later defines the eco-binding position Ep with sheets offset by a predetermined amount Of3 in the sheet discharging direction from the rear end reference position. This is to avoid interference between the stapling unit 26 for the left corner binding and the eco-binding unit (press-binding unit 27 to be described later). Thus, if the press-binding unit 27 is movably mounted on the device housing 20 between the binding position and a retracting position retracting therefrom similarly to the stapling unit 26, sheets need not be offset by the amount Of3 in the sheet discharging direction.

Here, the device front side Fr refers to the front side of the external casing 20*b* set by device designing where various kinds of operation are performed by an operator. Normally, a control panel, a mount cover (door) for a sheet cassette, and an open-close cover 28*c* through which staples are replenished for a stapling unit are arranged at this device front side. Further, the device rear side Re refers to the side of the device facing to a wall surface of a building, for example, when the device is installed (installation conditions; the back surface of the device is designed to face a wall).

Thus, in the illustrated device, the manual binding position Mp is defined on the device front side Fr and the eco-binding position Ep is defined on the device rear side Re outside the sheet carry-in area Ar with reference thereto. A distance Ofx between the manual binding position Mp and the reference of the sheet carry-in area Ar (sheet carry-in reference Sx) is set larger than a distance Ofy between the sheet carry-in reference Sx and the eco-binding position Ep (i.e., Ofx>Ofy).

Thus, the manual binding position Mp is defined to be apart from the sheet carry-in reference Sx of the processing tray 24 and the eco-binding position Ep is defined to be close to the sheet carry-in reference Sx. This is because the operation of setting a sheet bundle to the manual binding position Mp from the outside is facilitated to be convenient owing to that the manual binding position Mp is apart from the processing tray 24. Further, the eco-binding position Ep is defined to be close to the sheet carry-in reference Sx. This is because the movement amount when sheets carried in onto the processing tray 24 are offset-moved to the eco-binding position Ep can be small for speedy performance of the binding process (i.e., productivity improvement).

Moving Mechanism for Stapling Unit

Although detailed structure will be described later, the stapling unit 26 (first binding unit) includes a unit frame 26*a* (first unit frame), a staple cartridge 39, a stapling head 26*b*, and an anvil member 26*c*. The stapling unit 26 is supported by the device frame 20*a* to reciprocate by a predetermined stroke along a sheet end surface of the processing tray 24. The following describes the supporting structure.

Figure 9:
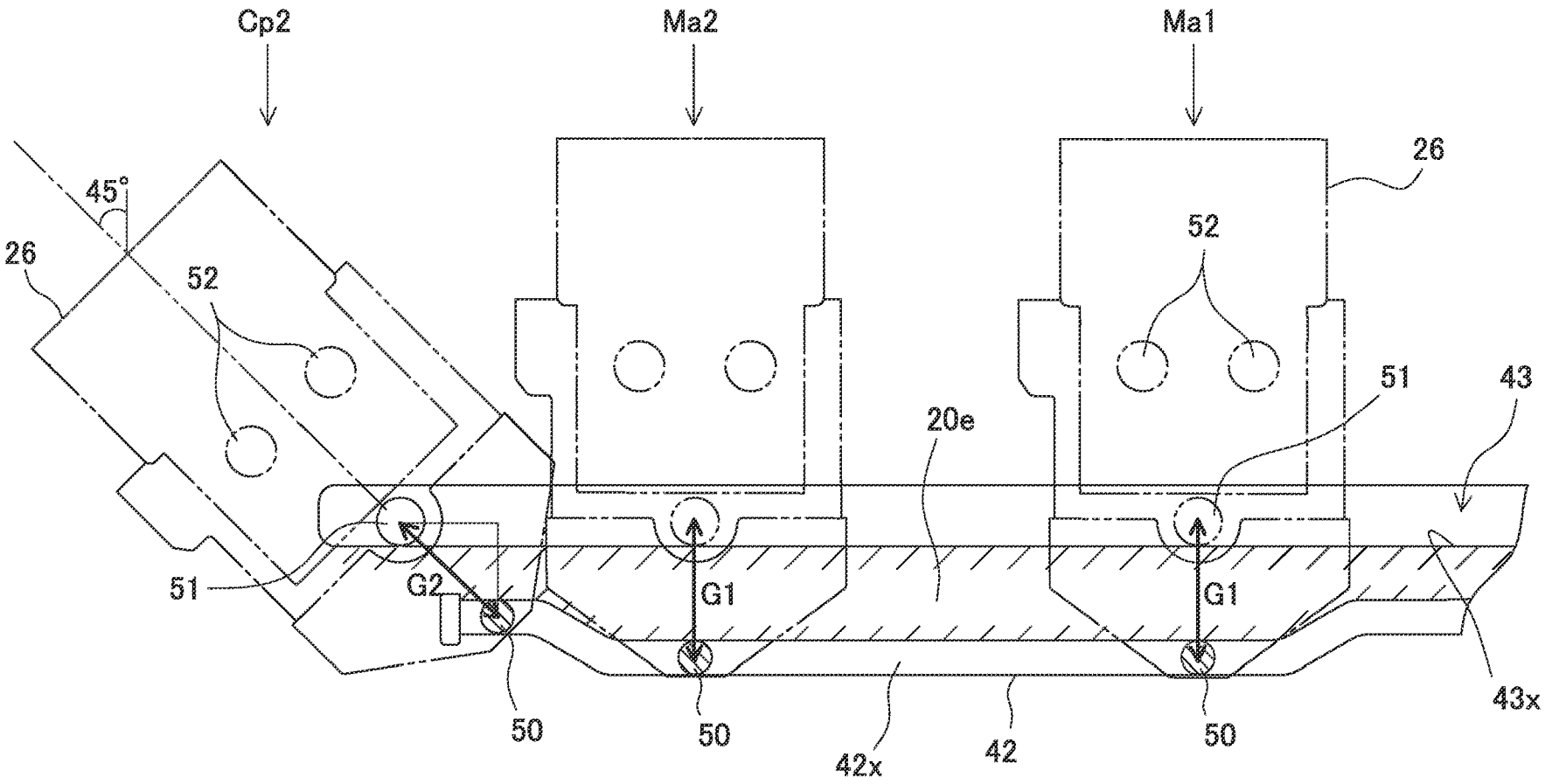
FIG. 9 is an explanatory view of multi-binding and left corner binding of the stapling unit.

FIG. 7 illustrates a structure as viewed from the front side, in which the stapling unit 26 is attached to the device frame 20*a*, and FIG. 8 is a plan view thereof. FIGS. 9 to 10C are partial explanatory views of a guide rail mechanism for guiding the stapling unit 26.

As illustrated in FIG. 7, a chassis frame (hereinafter, referred to as "bottom frame") 20*e* is attached to the right and left side frames 20*c* and 20*d* constituting the device frame 20*a*. The stapling unit 26 is mounted on the bottom frame 20*e* so as to be movable by the predetermined stroke. The bottom frame 20*e* is further provided with a travel guide rail (hereinafter, referred to simply as "guide rail") 42 and a slide cam 43. The guide rail 42 has a travel rail surface 42*x*, and the slide cam 43 has a travel cam surface 43*x*. In cooperation with each other, the travel rail surface 42*x* and the travel cam surface 43*x* support the stapling unit 26 (hereinafter, referred to as "movable unit" in this section) so as to be capable of reciprocating by the predetermined stroke and control the angular posture thereof.

The travel rail surface 42*x* and the travel cam surface 43*x* are formed so that the travel guide rail 42 and the slide cam 43 allows the movable unit 26 to reciprocate within a movement range SL (sheet carry-in area Ar, manual feed area Fr, and the eco-binding area Rr) (see FIG. 8). The travel guide rail 42 is constituted by a rail member having the stroke SL along the rear end regulating member 41 of the processing tray 24. In the illustrated example, the travel guide rail 42 is constituted as an opening groove formed in the bottom frame 20*e*. The travel rail surface 42*x* is formed at the edge of the opening and is arranged on the same straight line as the rear end regulating member 41 of the processing tray 24 as being in parallel thereto. The slide cam 43 is disposed distanced from the travel rail surface 42*x*. In the illustrated example, the slide cam 43 is constituted by a groove cam formed in the bottom frame 20*e*. The groove cam has the travel cam surface 43*x*.

A drive belt 44 connected to a drive motor (travel motor) M11 is fixed to the movable unit (stapling unit) 26. The drive belt 44 is wound around a pair of pulleys axially supported by the device frame 20*e*, and the drive motor is connected to one of the pulleys. Thus, the stapling unit 26 reciprocates by the stroke SL with forward and reverse rotation of the travel motor M11.

The travel rail surface 42*x* and the travel cam surface 43*x* are arranged to include parallel distance sections 43*a* and 43*b* (each having a span G1) where the surfaces are in parallel, narrow swing distance sections 43*c* and 43*d* (each having a span G2), and a narrower swing distance section 43*e* (having a span G3). Here, the spans satisfy the relation of "G1>G2>G3". The span G1 causes the stapling unit 26 to be in a posture as being in parallel to the sheet rear end edge. The span G2 causes the stapling unit 26 to swing into an inclined posture rightward or leftward. The span G3 causes the stapling unit 26 to swing into an inclined posture at a larger angle.

Not limited to the opening groove structure, the travel guide rail 42 may adopt a variety of structures such as a guide rod, a projection rib, and others. Further, not limited to the groove cam, the slide cam 43 may adopt a variety of shapes as long as it has a cam surface to guide the movable unit 26 in a predetermined stroke direction, such as a projection stripe rib member.

The movable unit 26 is engaged with the travel guide rail 42 and the slide cam 43 as follows. As illustrated in FIG. 7, the movable unit 26 is provided with a first rolling roller (rail fitting member) 50 engaged with the travel rail surface 42*x* and a second rolling roller (cam follower member) 51 engaged with the travel cam surface 43*x*. Further, the movable unit 26 is provided with a sliding roller 52 engaged with a support surface of the bottom frame 20*e*. The illustrated movable unit 26 includes two ball-shaped sliding rollers 52*a* and 52*b* at two positions thereof. Further, a guide roller 53 engaged with the bottom surface of the bottom frame 20*e* is formed in the movable unit 26 to prevent the movable unit 26 from floating from the bottom frame 20*e*.

With the above configuration, the movable unit 26 is movably supported by the bottom frame 20*e* through the sliding rollers 52*a*, 52*b* and the guide roller 53. Further, the first rolling roller 50 and the second rolling roller 51 are rotated and moved along the travel rail surface 42*x* and the travel cam surface 43*x*, respectively, so as to follow the travel rail surface 42*x* and the travel cam surface 43*x*, respectively.

The travel rail surface 42*x* and the travel cam surface 43*x* are arranged so that the parallel distance sections (span G1) are arranged at the position 43*a* corresponding to the above-mentioned multi-binding positions Ma1, Ma2 and the position 43*b* corresponding to the manual binding position Mp. With the span G1, the movable unit 26 is maintained in a posture perpendicular to the sheet end edge without being swung, as illustrated in FIGS. 9 and 10C. Accordingly, at the multi-binding positions Ma1, Ma2 and the manual binding position Mp, a sheet bundle is bound with a staple being in parallel to the sheet end edge.

Figure 10A:
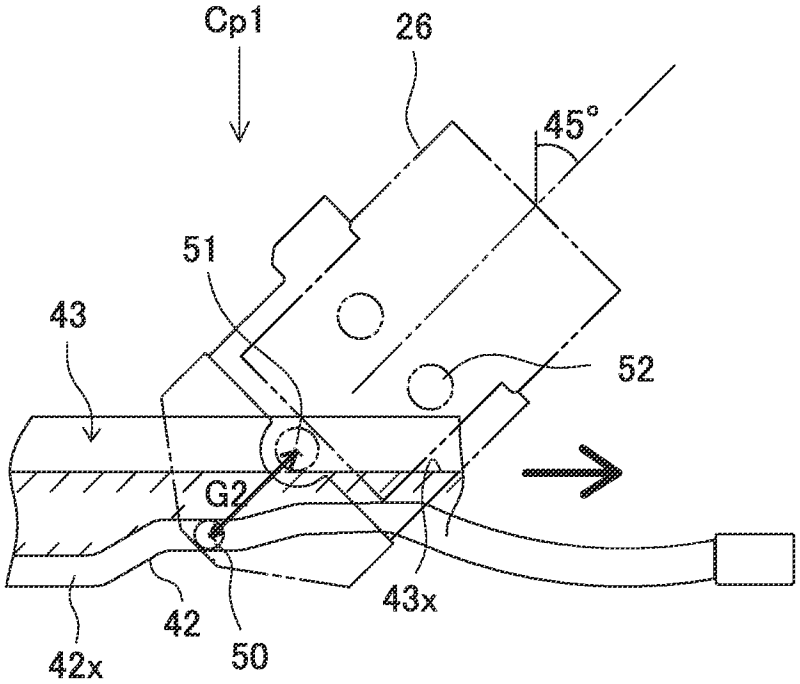

Further, the travel rail surface 42*x* and the travel cam surface 43*x* are arranged so that the swing distance sections (span G2) are arranged at the position 43*e* corresponding to the right corner binding position and the position 43*d* corresponding to the left corner binding position. The movable unit 26 is maintained in a rightward-angled posture (for example, rightward-angled by 45°) or in a leftward-angled posture (for example, leftward-angled by 45°), as illustrated in FIGS. 9 and 10A.

Further, the travel rail surface 42*x* and the travel cam surface 43*x* are arranged so that the swing distance section (span G3) is arranged at the position 43*c* facing a position for staple loading. The span G3 is formed to be smaller than the span G2. In this state, the movable unit 26 is maintained in a rightward-angled posture (for example, rightward-angled by 60°) as illustrated in FIG. 10B. The reason why the angular posture of the movable unit 26 is changed at the staple loading position is that the posture is matched with an angular direction in which the staple cartridge 39 is mounted. The angle is set in relation with the open-close cover arranged at the external casing 20*b*.

For changing the angular posture of the movable unit 26 using the travel rail surface 42*x* and the travel cam surface 43*x*, it is preferable, from a viewpoint of compactness in layout (to reduce a movement distance), to arrange a second travel cam surface or a stopper cam surface for angle change in cooperation with the travel cam surface 43*x*.

The illustrated stopper cam surface will now be described. As illustrated in FIG. 8, stopper surfaces 43*y* and 43*z* to be engaged with a part of the movable unit 26 (sliding roller 52*a*) are arranged at the bottom frame 20*e* to change a posture of the movable unit 26 between the right corner binding position Cp1 and the manual binding position Mp on the device front side. Thus, the movable unit 26 inclined at the staple loading position is required to be corrected in inclination at the manual binding position Mp; however, when the angle is changed only by the cam surface and rail surface, the movement stroke becomes long.

Thus, when the movable unit 26 is moved toward the manual binding position Mp in a state of being locked by the stopper surface 43*y*, the inclination of the movable unit 26 is corrected. Further, when the movable unit 26 is returned to the opposite direction from the manual binding position Mp, the movable unit 26 is (forcedly) inclined to face the corner binding position Cp1 by the stopper surface 43*z*.

Stapling Unit

Figure 13A:
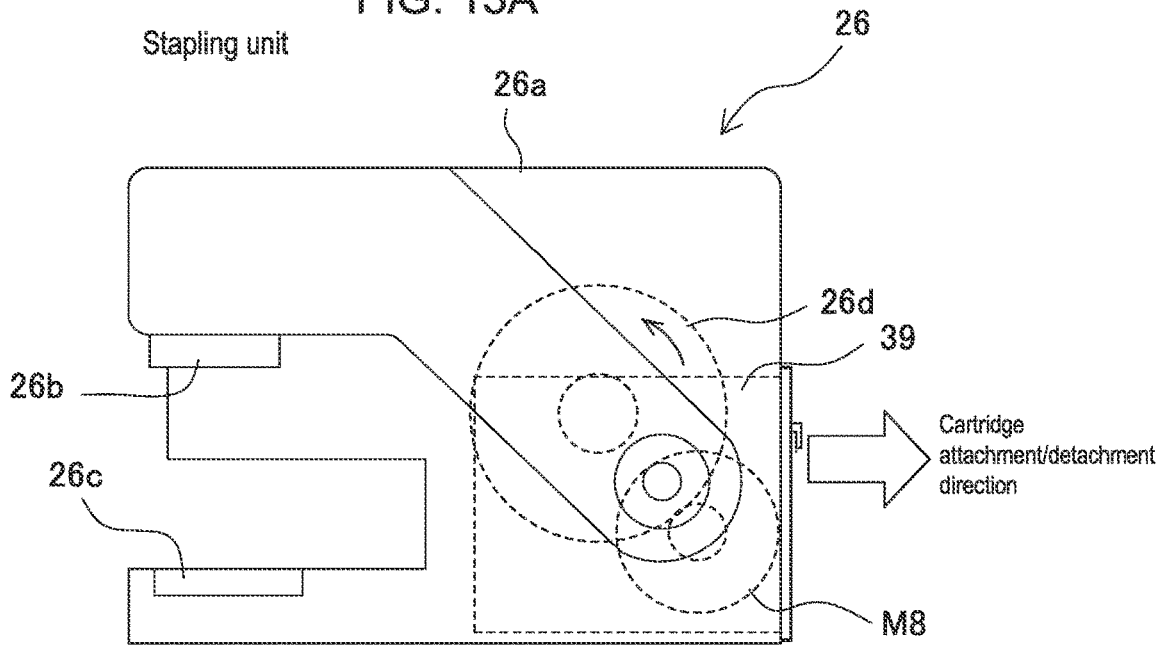
FIG. 13A is an explanatory view of the configuration of the stapling unit.

The stapling unit 26 has been widely known as means for performing binding processing using a staple. An example thereof will be described with reference to FIG. 13A. The stapling unit 26 is configured as a unit separated from the sheet bundle binding device (post-processing device B). The stapling unit 26 includes a box-shaped unit frame 26*a*, a drive cam 26*d* axially swingably supported by the unit frame 26*a*, and a drive motor M8 mounted on the unit frame 26*a* to rotate the drive cam 26*d*.

The stapling head 26*b* and the anvil member 26*c* are arranged at a binding position so as to be mutually opposed. The stapling head 26*b* is vertically moved between a waiting position on the upper side and a stapling position on the lower side (the anvil member 26*c*) with the drive cam 26*d* and a biasing spring (not illustrated). Further, the staple cartridge 39 is mounted on the unit frame 26*a* in a detachably attachable manner.

Linear blank staples are stored in the staple cartridge 39 and fed to the stapling head 26*b* by a staple feeding mechanism. The stapling head 26*b* incorporates a former member to fold a linear staple internally into a U-shape and a driver to cause the folded staple to bite into a sheet bundle. With such a configuration, the drive cam 26*d* is rotated by the drive motor M8 to store energy in the biasing spring. When the rotational angle reaches a predetermined angle, the stapling head 26*b* is vigorously lowered toward the anvil member 26*c*. Owing to this action, a staple is caused to bite into a sheet bundle with the driver after being folded into a U-shape. Then, leading ends of the staple are folded by the anvil member 26*c*, whereby staple-binding is completed.

The staple feeding mechanism is incorporated in between the staple cartridge 39 and the stapling head 26*b*. A sensor (empty sensor) to detect the absence of the staple is arranged in the staple feeding mechanism. Further, the unit frame 26*a* has a cartridge sensor (not illustrated) to detect whether or not the staple cartridge 39 is inserted.

The illustrated staple cartridge 39 adopts a structure in which staples connected in a belt shape are stacked in a layered manner, or are stored in a roll-shape, in a box-shaped cartridge.

Further, the unit frame 26*a* has a circuit to control the abovementioned sensors and a circuit board to control the drive motor M8, and an alarm signal is issued when the staple cartridge 39 is not mounted or the staple cartridge 39 is empty. Further, the stapling control circuit controls the drive motor M8 to perform the stapling operation with a staple signal and transmits an "operation completion signal" when the stapling head 26*b* is moved to an anvil position from the waiting position and returned to the waiting position.

Press-Binding Unit

The structure of the press-binding unit 27 will be described based on FIG. 13B. As a press-binding mechanism, there have been known a fold-binding mechanism (see JP 2011-256008A) to perform binding by forming cutout openings in a binding portion of a plurality of sheets and mating by folding a side of each sheet and a press-binding mechanism to perform binding by pressing and deforming a sheet bundle with corrugated surfaces formed on pressurizing surfaces 27*b* and 27*c* which are capable of pressure-contacting with and separating from each other.

Figure 13B:
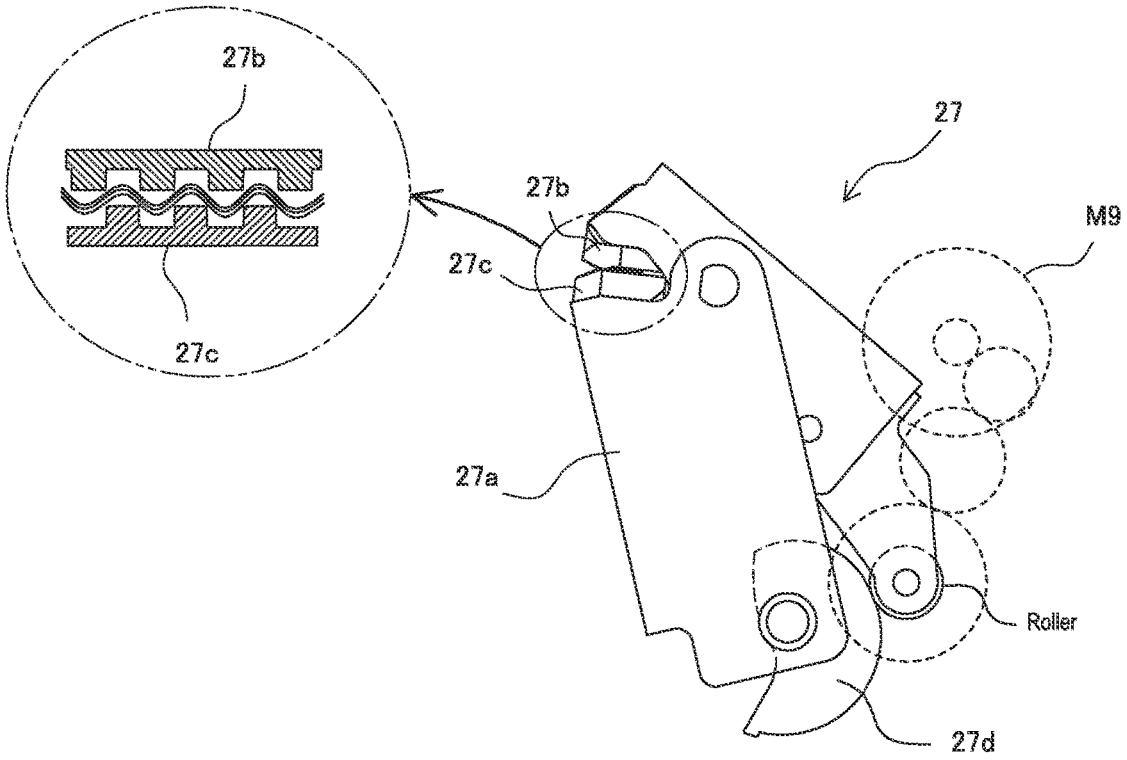
FIG. 13B is an explanatory view of a press-binding unit.

FIG. 13B illustrates the press-binding unit 27. A movable frame member 27*d* is swingably axially supported by a base frame member 27*a*, and both the frames are swung about a support shaft 27*x* so as to be capable of pressure-contacting with and separating from each other. The movable frame member 27*d* has a follower roller 27*f* with which a drive cam 27*e* arranged at the base frame member 27*a* is engaged.

A drive motor M9 arranged at the base frame member 27*a* is connected to the drive cam 27*e* through a deceleration mechanism. Rotation of the drive motor M9 causes the drive cam 27*e* to be rotated, and the movable frame member 27*d* is swung by a cam surface (eccentric cam in FIG. 13B) thereof.

The lower pressurizing surface 27*c* and the upper pressurizing surface 27*b* are arranged respectively at the base frame member 27*a* and the movable frame member 27*d* so as to be opposed to each other. A biasing spring (not illustrated) is arranged between the base frame member 27*a* and the movable frame member 27*d* to bias both the pressurizing surfaces in a direction to be separated.

As illustrated in an enlarged view of FIG. 13B, convex stripes are formed on one of the upper pressurizing surface 27*b* and the lower pressurizing surface 27*c* and concave grooves to be matched therewith are formed on the other thereof. The convex stripes and the concave grooves are each formed into a rib-shape having a predetermined length. Sheets of a sheet bundle nipped between the upper pressuring surface 27*b* and the lower pressurizing surface 27*c* are deformed into a corrugation shape to closely adhere to one another. A position sensor (not illustrated) is arranged at the base frame member (unit frame) 27*a* and detects whether or not the upper and lower pressurizing surfaces 27*b* and 27*c* are at the pressurization positions or separated positions.

Stack Tray

Figure 14:
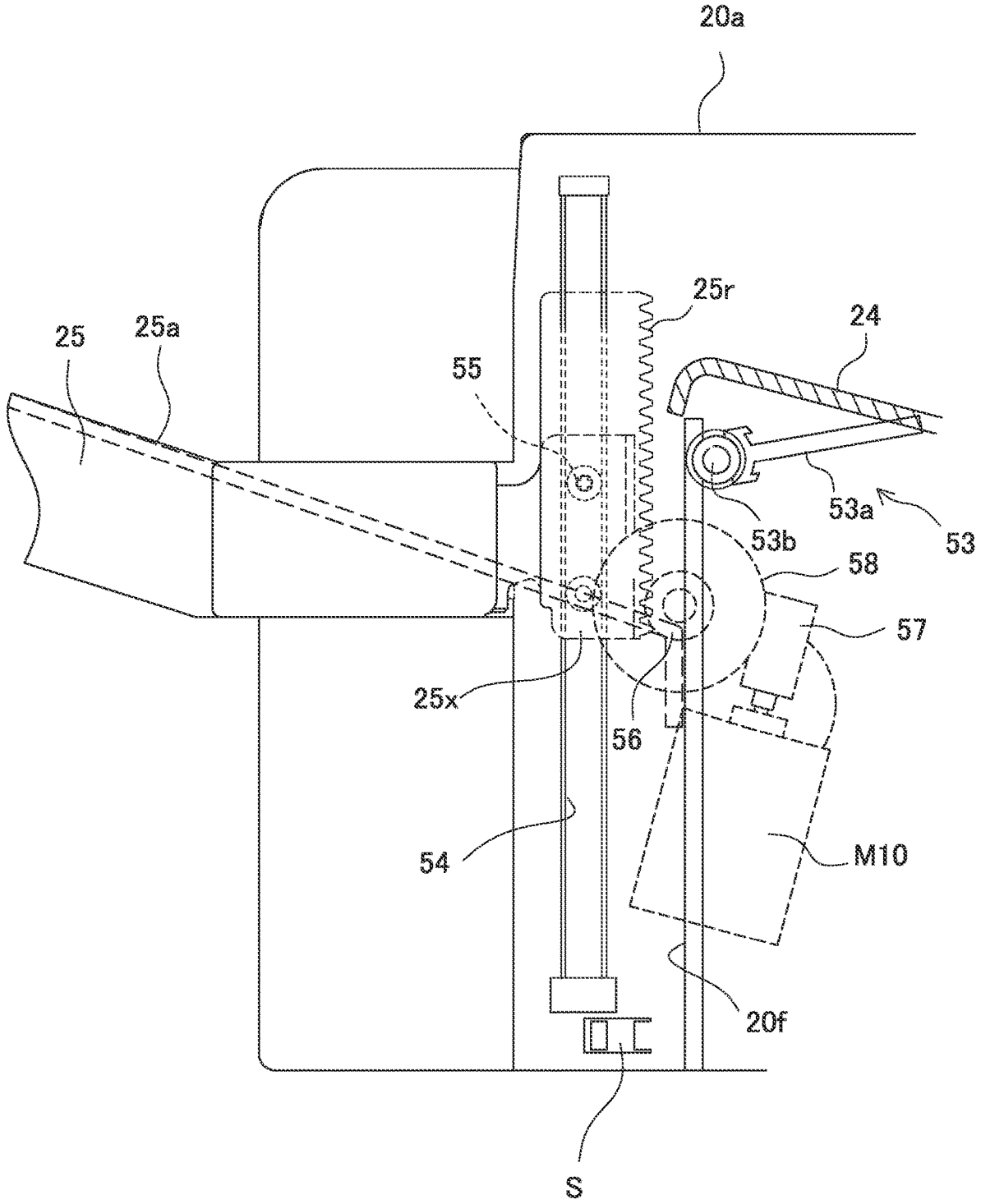
FIG. 14 is an explanatory view of the configuration of the stack tray in the device of FIG. 2.

The structure of the stack tray 25 will be described based on FIG. 14. The stack tray 25 is disposed at a location downstream from the processing tray 24. A sheet bundle accumulated on the processing tray 24 is stacked and stored onto the stack tray 25. A tray elevation mechanism is provided so that the stack tray 25 is sequentially lowered in accordance with a stacked amount thereon. The height of a stack surface 25*a* of the stack tray 25 is controlled so that the uppermost sheet thereon is approximately flush with the sheet placing surface 24*a* of the processing tray 24. Further, the stacked sheets are inclined by an angle with a rear end edge in the sheet discharging direction abutting against a tray aligning surface 20*f* (standing surface) by gravity.

Specifically, an elevation rail 54 is vertically fixed in the stacking direction to the device frame 20*a*. A tray base body 25*x* is slidably fitted to the elevation rail 54 so as to be capable of being lifted and lowered using a slide roller 55 or the like. A rack 25*r* is formed in the elevation direction integrally with the tray base body 25*x*. A drive pinion 56 axially supported by the device frame 20*a* is engaged with the rack 25*r*. Then, an elevation motor M10 is connected to the drive pinion 56 through a worm gear 57 and a worm wheel 58.

Accordingly, when the elevation motor M10 is rotated forwardly and reversely, the rack 25*r* connected to the drive pinion 56 is vertically moved to the upper side and lower side of the device frame 20*a*. With the above configuration, the tray base body 25*x* is elevated in a cantilevered state. Besides such a rack-pinion mechanism, the tray elevation mechanism may adopt a pulley-mounted belt mechanism or the like.

The stack tray 25 is integrally attached to the tray base body 25*x*. Sheets are stacked and stored on the stack surface 25*a* thereof. The tray aligning surface 20*f* to support sheet rear end edges is vertically formed in the sheet stacking direction. In the illustrated example, the tray aligning surface 20*f* is formed with the device casing.

Further, the stack tray 25 integrally attached to the tray base body 25*x* is arranged so as to be inclined in an illustrated angled direction. The angle (for example, 20° to 60°) is set so that sheet rear ends abut against the tray aligning surface 20*f* by the own weight of the sheets.

Sheet Holding Mechanism

The stack tray 25 has a sheet holding mechanism 53 to press the uppermost sheet stacked. The illustrated sheet holding mechanism 53 includes an elastic pressing member 53*a* to press the uppermost sheet, an axially-supporting member 53*b* to cause the elastic pressing member 53*a* to be axially supported by the device frame 20*a* so as to be rotatable, a drive motor M2 to rotate the axially-supporting member 53*b* by a predetermined angle, and a transmitting mechanism thereof. The illustrated drive motor M2 is drive-connected to the drive motor of the sheet bundle carry-out mechanism 60 as a drive source. When a sheet bundle is carried in (carried out) to the stack tray 25, the elastic pressing member 53*a* is retracted outside the stack tray 25. After the rear end of the sheet bundle is stored on the uppermost sheet on the stack tray 25, the elastic pressing member 53*a* is rotated counterclockwise from the waiting position and engaged with the uppermost sheet to press the same.

Then, owing to an initial rotational operation of the drive motor M2 to carry out a sheet bundle on the processing tray 24 toward the stack tray 25, the elastic pressing member 53*a* is retracted from a sheet surface of the upmost sheet on the stack tray 25 to the retracting position.

Level Sensor

The stack tray 25 has a level sensor to detect a sheet height of the uppermost sheet. The lifting motor is rotated based on a detection signal from the level sensor, so that the stack surface 25*a* is lifted. A variety of mechanisms are known as the level sensor mechanism. In the illustrated example, the level sensor mechanism adopts a detection method configured to emit a detection light from the tray aligning surface 20*f* of the device frame 20*a* to the tray upper side to detect the reflection light thereof and detect whether or not a sheet exists at the height position of the reflection light.

Stack Sheet Amount Sensor

Similarly to the level sensor, a sensor to detect that the sheets are detached from the stack tray 25 is arranged at the stack tray 25. Although the structure thereof will not be described in detail, it is possible to detect whether or not sheets exist on the stack surface, for example, by arranging a sensor lever rotated integrally with the elastic pressing member 53*a* and detecting the sensor lever with a sensor element. When the height position of the sensor lever becomes different (varied) before and after carry-out of a sheet bundle, the controller 75 to be described later stops the sheet discharging operation or lifts the stack tray 25 to a predetermined position, for example. Such an operation is performed in an abnormal case, for example, in a case where a user carelessly removes sheets from the stack tray 25 during operation. Further, a lower limit position is defined for the stack tray 25 not to be lowered abnormally. A limit sensor Se3 to detect the stack tray 25 is arranged at the lower limit position.

Image Forming System

Figure 1:
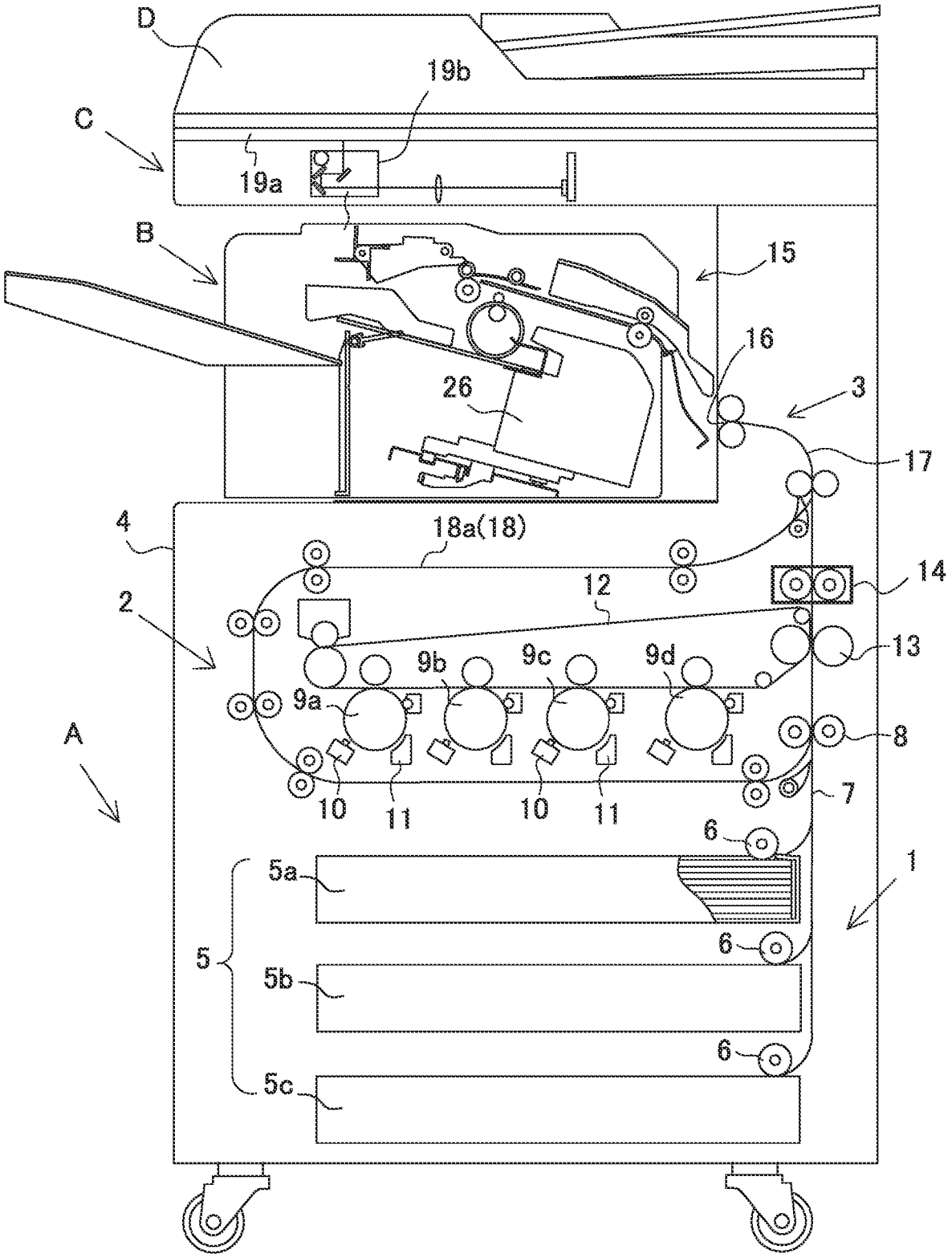
FIG. 1 is an explanatory view of the entire configuration of an image forming system according to the present invention.

As illustrated in FIG. 1, the image forming unit A includes a sheet feed part 1, an image forming part 2, a sheet discharge part 3, and a signal processing part (not illustrated) which are incorporated in a device housing 4. The sheet feed part 1 includes a cassette 5 in which sheets are stored. In the illustrated example, the sheet feed part 1 includes a plurality of the cassettes 5*a*, 5*b*, 5*c* to be capable of storing sheets having different sizes. Each of the cassettes 5*a*, 5*b*, 5*c* incorporates a sheet feed roller 6 to feed a sheet and a separating unit (a separating pawl, a separating roller, or the like) to separate sheets one from another.

Further, a sheet feed path 7 is provided in the sheet feed part 1 for feeding a sheet from each cassette 5 to the image forming part 2. A resist roller pair 8 is provided at the end of the sheet feed path 7, so that a sheet fed from each cassette 5 is aligned at the front end thereof and caused to wait until being fed in accordance with image forming timing of the image forming part 2.

Thus, the sheet feed part 1 includes a plurality of cassettes in accordance with device specifications and feeds a sheet of a size selected by a controller to the image forming part 2 located on the downstream side. Each cassette 5 is mounted on the device housing 4 in a detachable manner to be capable of replenishing sheets.

The image forming part 2 may adopt one of various image forming mechanisms to form an image on a sheet. The illustrated one is an electrostatic image forming mechanism. As illustrated in FIG. 1, a plurality of drums 9*a* to 9*d* each including a photo conductor are arranged in accordance with color elements in the device housing 4. A light emitter (laser head or the like) 10 and a developer 11 are arranged around each of the drums 9*a* to 9*d*. A latent image (electrostatic image) is formed by the light emitter 10 on each of the drums 9*a* to 9*d*, and toner ink is caused to adhere thereto by the developer 11. The ink images adhering to the respective drums 9*a* to 9*d* are transferred onto a transfer belt 12 for respective color components for image synthesis.

The transferred image formed on the transfer belt 12 is transferred by a charger 13 onto a sheet fed from the sheet feed part 1 and fixed by a fixing device (heating roller) 14, and then, is fed to the sheet discharge part 3.

The sheet discharge part 3 includes the sheet discharge port 16 to discharge a sheet to the sheet discharge space 15 formed in the device housing 4 and a sheet discharge path 17 to guide the sheet from the image forming part 2 to the sheet discharge port 16. A duplex path 18 to be described later is continuously arranged from the sheet discharge part 3, so that a sheet having an image formed on the front surface thereof is fed again to the image forming part 2 after being face-reversed.

The sheet having an image formed on the front surface thereof by the image forming part 2 is face-reversed and re-fed to the image forming part 2 through the duplex path 18. The sheet is discharged from the sheet discharge port 16 after an image is formed on the back surface by the image forming part 2. To this end, the duplex path 18 includes a switchback path to re-feed a sheet fed from the image forming part 2 in the device by inverting the conveying direction thereof and a U-turn path 18*a* to face-reverse the sheet re-fed into the device. In the illustrated example, the switchback path is formed on the sheet discharge path 22 of the post-processing unit B.

Image Reading Unit

The image reading unit C includes a platen 19*a* and a reading carriage 19*b* that reciprocates along the platen 19*a*. The platen 19*a* is formed of transparent glass and includes a still image reading surface to scan a still image with movement of the reading carriage 19*b* and a travel image reading surface to read a document image travelling at a predetermined speed.

The reading carriage 19*b* includes a light source lamp, a reflection mirror to polarize reflection light from a document, and a photoelectric conversion element (not illustrated). The photoelectric conversion element includes line sensors arranged in the document width direction (main scanning direction) on the platen 19*a*. The reading carriage 19*b* reciprocates in a sub scanning direction perpendicular thereto, so that a document image can be read in line order. Further, an automatic document feeding unit D to cause a document to travel at a predetermined speed is arranged above the travel image reading surface of the platen 19*a*. The automatic document feeding unit D includes a feeding mechanism to feed document sheets set on a sheet feed tray to the platen 19*a* one by one and to store each document sheet in a sheet discharge tray after each image is read.

Paper Guide Mechanism

The processing tray 24 is provided with a paper guide mechanism 80 for guiding a sheet bundle between the pressurizing surfaces 27*b* and 27*c* of the press-binding unit 27 when the sheet bundle is moved from the alignment position to the binding position Ep with the operation of the side aligning member 46F.

Figure 15A:
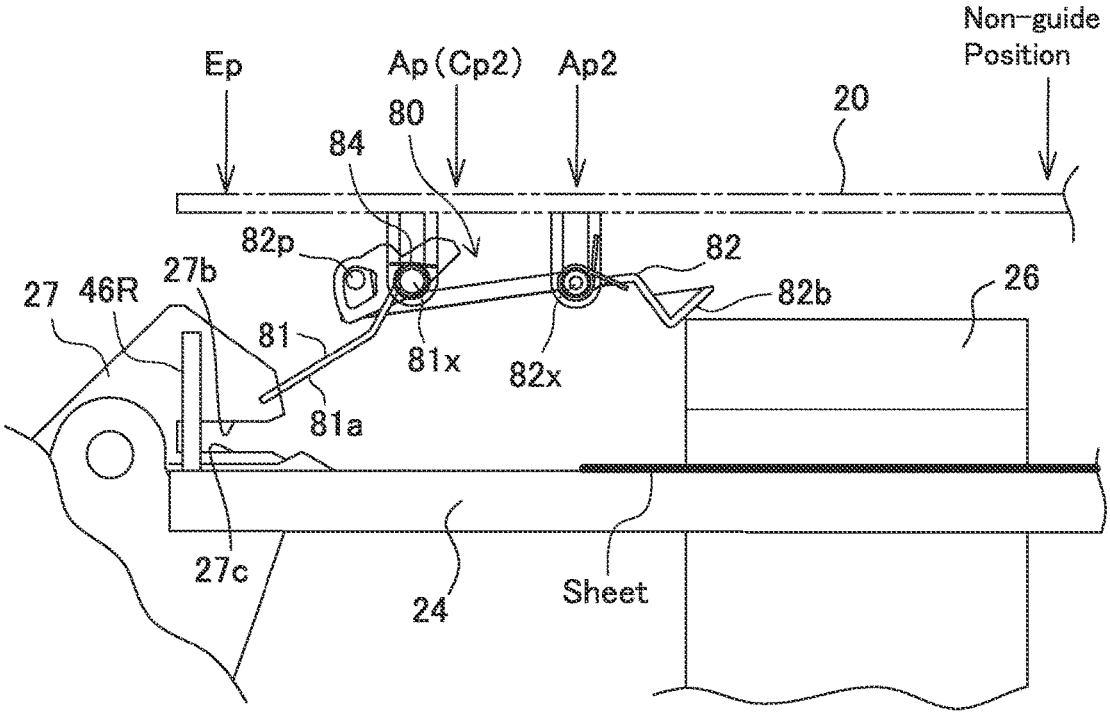
Figure 15B:
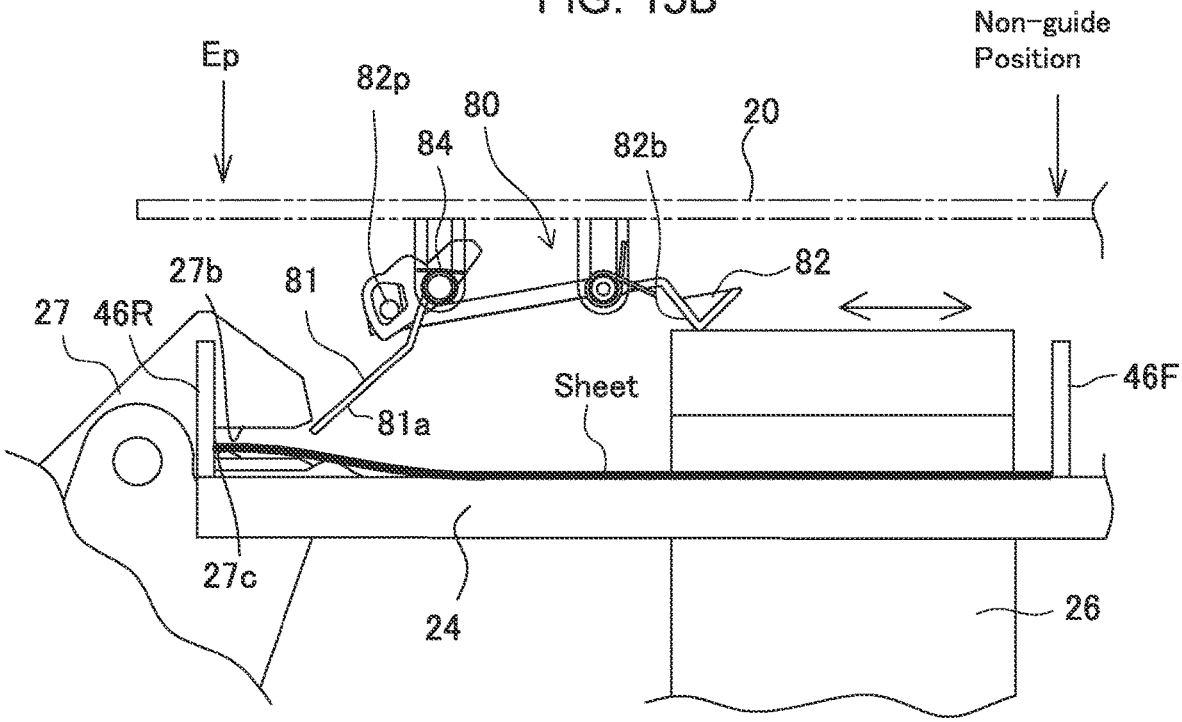

FIGS. 15A and 15B illustrate the paper guide mechanism 80. The device frame 20*a* has, above the processing tray 24, a paper guide member 81 to guide a sheet bundle from the alignment position Ap3 to the binding position Ep. The paper guide member 81 has a guide surface 81*a* to guide a sheet bundle to the space between a pair of the vertically-opposed pressurizing surfaces 27*b* and 27*c* of the press-binding unit 27.

When sheets are carried in onto the processing tray 24, the paper guide member 81 is retracted to above the processing tray 24 to avoid interference therewith. When sheets are to be offset-moved toward the binding position after stacked, the guide surface 81*a* of the paper guide member 81 is arranged to be at a different height position to guide an upper surface of the sheets.

The paper guide member 81 is supported by the device frame 20*a* swingably about a support shaft 81*x*. A biasing spring 84 for biasing the guide surface 81*a* toward either a high position or a low position is arranged at the axially supporting portion. Further, a transmission lever 82 is connected to the paper guide member 81 with a transmission pin 82*p*. Owing to swing motion of the transmission lever 82, the guide surface 81*a* is shifted from a height position of FIG. 15A as being retracted to above the processing tray 24 to a low height position of FIG. 15B. Accordingly, an end part 82*a* of the transmission lever 82 is moved to a position to be engaged with the unit frame 26*a* of the stapling unit 26.

That is, the transmission lever 82 is arranged swingably about a support shaft 82*x*, and an end part thereof is connected to the paper guide member 81 via the transmission pin 82*p*. Further, the other end part 82*b* of the transmission lever 82 is arranged within a movement trajectory of the stapling unit 26. The controller 75 to be described later causes the stapling unit 26 to move between a previously set guide position Gp and a retracting position Np. When being at the guide position Gp, the paper guide member 81 is in a guiding posture (in a state of FIG. 15B) to be engaged with the upper surface of sheets on the processing tray 24. When being at the retracting position Np, the paper guide member 81 is at the retracting position (in a state of FIG. 15A) where it is retracted above the processing tray 24.

Here, the relation between the movement position of the stapling unit 26 and the retracting position and the guide position of the paper guide member 81 is set. In the present embodiment, the alignment position for performing eco-binding processing is set at the sheet center Sx of carried sheets. When sheets are to be carried in, the stapling unit 26 is moved into the vicinity of a position where it is engaged with the paper guide member 81 and waits at the position until carry-in and aligning of the sheets are completed. After carry-in of sheets is completed, the stapling unit 26 is moved from a position just after the multi binding position (Ma2) to a position just before the rear side corner binding position Cp2. Then, the other end part 82*b* of the transmission lever 82 is moved from the retracting position of the stapling unit 26 to the guide position, and the paper guide member 81 prepares for shifting of a sheet bundle with the side aligning member 46F.

With the above configuration, rapid response for carry-in and aligning of sheets can be obtained with the stapling unit 26 kept waiting at the multi-binding position when stacking a sheet bundle onto the processing tray 24. After completion of carry-in and aligning of the sheets, it is possible to prepare for movement of the sheet bundle with the stapling unit 26 moved to a position just before the rear side corner. Here, the paper guide member 81 may be lowered at the rear side corner position (Cp2) to be the guide position; however, since moving to the guide position is performed with the normal rear side corner binding without adopting eco-binding, it is preferable that the paper guide member 81 be operated to be lowered at a position to avoid influencing other operations as in the present embodiment, that is, at the position Gp in a range from right after the multi-binding position (Ma2) to right before the rear corner binding position (Cp2).

Then, with the operation of the sheet offset unit (side aligning member 46F), the sheet bundle is moved toward the eco-binding position Ep. At that time, the paper guide member 81 guides the sheet upper surface between the pressurizing surfaces 27*b* and 27*c* of the press-binding unit 27 in a state of FIG. 15B. When the eco-binding processing is thus set, an operation of positioning the paper guide member 81 at the retracting position upon sheet discharge and at the guide position upon shifting to the eco-binding position is performed every time one sheet is discharged.

In the above description, the paper guide member 81 is configured to be vertically moved between the retracting position Np and the guide position Gp in conjunction with the movement of the stapling unit 26. However, the paper guide member 81 may be interlocked, for example, with a solenoid other than the stapling unit 26 so as to be vertically moved between the retracting position and the guide position.

Description of Control Configuration

Figure 16:
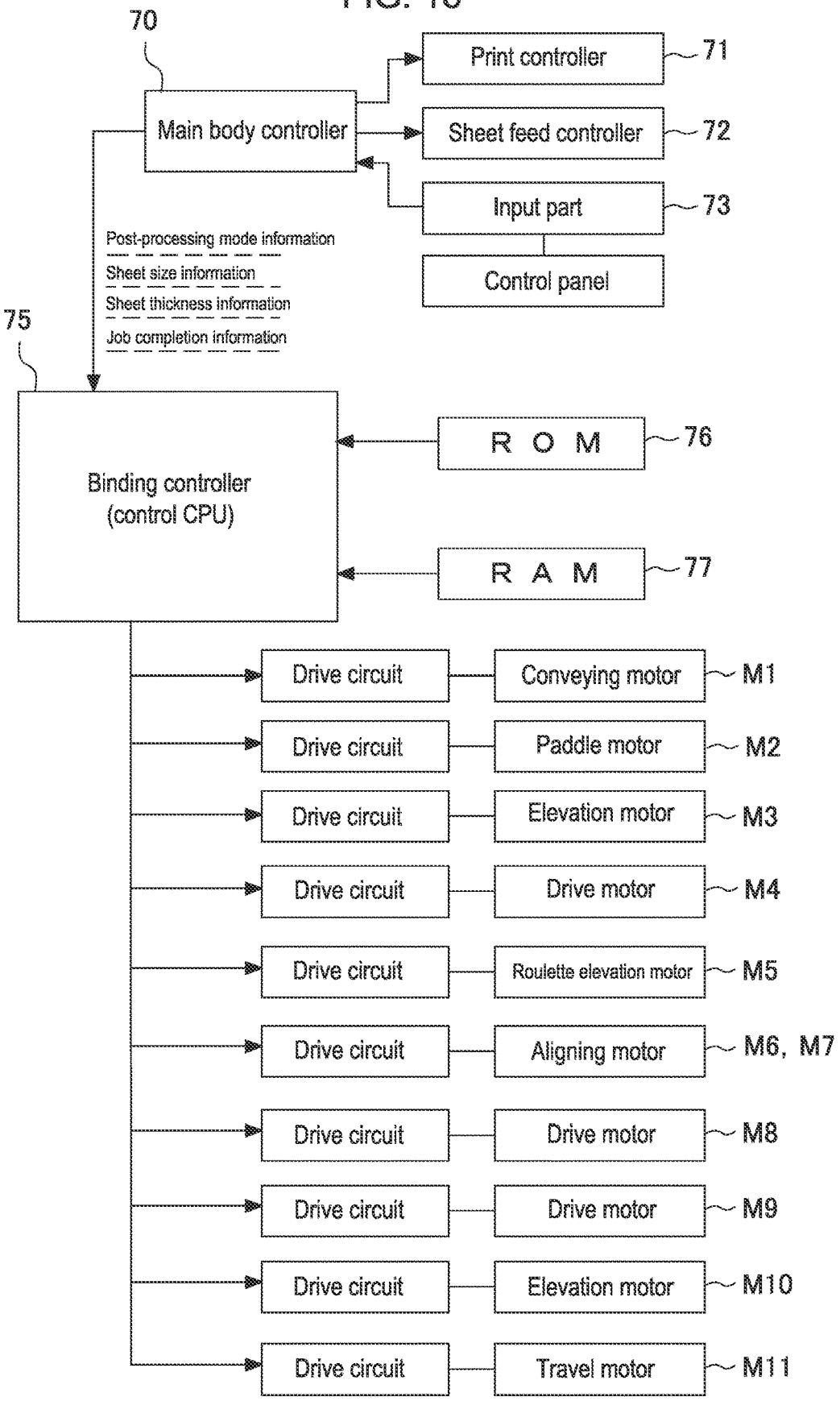
FIG. 16 is an explanatory view of a control configuration of the device of FIG. 1.

The control configuration of the abovementioned image forming system will be described according to a block diagram of FIG. 16. The image forming system illustrated in FIG. 16 includes a controller (hereinafter, referred to as "main body controller") 70 for the image forming unit A and a controller (hereinafter, referred to as "binding controller") 75 for the post-processing unit B (sheet bundle binding device). The main body controller 70 includes a print controller 71, a sheet feed controller 72, and an input part 73 (control panel).

Setting an "image forming mode" and a "post-processing mode" is manipulated by use of the input part (control panel) 73. Inputting for the image forming mode includes a print mode such as color/monochrome printing and double-side/single-side printing, and image forming conditions such as a sheet size, sheet quality, the number of copies, and enlarged/reduced printing. Further, the "post-processing mode" includes a "printout mode", a "staple binding mode", an "eco-binding mode", and a "jog sorting mode". Further, in the illustrated example, a "manual binding mode" is provided. In this mode, sheet bundle binding processing is carried out offline separately from the main body controller 70 for the image forming unit A.

The main body controller 70 transfers, to the binding controller 75, selection of the post-processing mode and data such as the number of sheets, the number of copies, and the thickness of sheets on which images are formed. Further, the main body controller 70 transfers a job completion signal to the binding controller 75 every time image forming operation is completed.

The post-processing mode will now be described in the following. In the "printout mode", a sheet from the sheet discharge port 23 is stored on the stack tray 25 through the processing tray 24 without binding processing being performed. In this case, sheets are overlapped and stacked on the processing tray 24, and a stacked sheet bundle is carried out to the stack tray 25 according to the jog completion signal from the main body controller 70.

In the "staple binding mode (second sheet discharge mode)", sheets from the sheet discharge port 23 are stacked and aligned on the processing tray 24, and the resultant sheet bundle is stored on the stack tray 25 after the binding processing. In this case, sheets on which images are to be formed are specified by an operator basically to have the same thickness and size. In the staple binding mode, one of the "multi-binding", "right corner binding", and "left corner binding" is selected and specified. The binding positions thereof are as described above.

In the "jog sorting mode", sheets are divided into a group whose sheets having images formed at the image forming unit A are offset and stacked on the processing tray 24 and a group whose sheets are stacked thereon without being offset. An offset sheet bundle and a non-offset sheet bundle are alternately stacked on the stack tray 25. In the illustrated example, an offset area (see FIG. 5) is provided on the device front side. Then, sheets carried out from the sheet discharge port 23 onto the processing tray 24 in center reference Sx are divided into a group whose sheets are stacked maintaining the above posture and a group whose sheets are stacked being offset to the device front side Fr by a predetermined amount.

The reason why the offset area is provided on the device front side Fr is to maintain an operational area at the device front side Fr for the manual binding process, a replacing process of a staple cartridge, and the like. The offset area is set to have dimensions (in the order of several centimeters) to divide sheet bundles.

Manual Binding Mode

The manual feed setting part 29 where an operator sets a sheet bundle to be bound is provided on the device front side of the external casing 20*b*. A sensor to detect a set sheet bundle is provided on the manual feed setting surface 29*a* of the manual feed setting part 29. With a signal from the sensor, the binding controller 75 to be described later moves the stapling unit 26 to the manual binding position. Subsequently, when an operation switch 30 is depressed by an operator, the binding processing is performed.

Thus, the manual binding mode is controlled offline by the binding controller 75 and the main body controller 70. When the manual binding mode and the staple binding mode are to be performed concurrently, either mode is set to have priority.

Binding Controller

The binding controller 75 causes the post-processing unit B to operate in accordance with the post-processing mode set by the image forming controller 70. The illustrated binding controller 75 is constituted by a control CPU (hereinafter, referred to merely as "controller"). The controller 75 is connected with a ROM 76 and a RAM 77. A sheet discharge operation to be described later is performed with control programs stored in the ROM 76 and control data stored in the RAM 77. To this end, drive circuits for all the above-mentioned drive motors are connected to the controller 75, so that start, stop, and forward-reverse rotation of the motors are controlled thereby.

Description of Eco-Binding Operation

Figure 17:
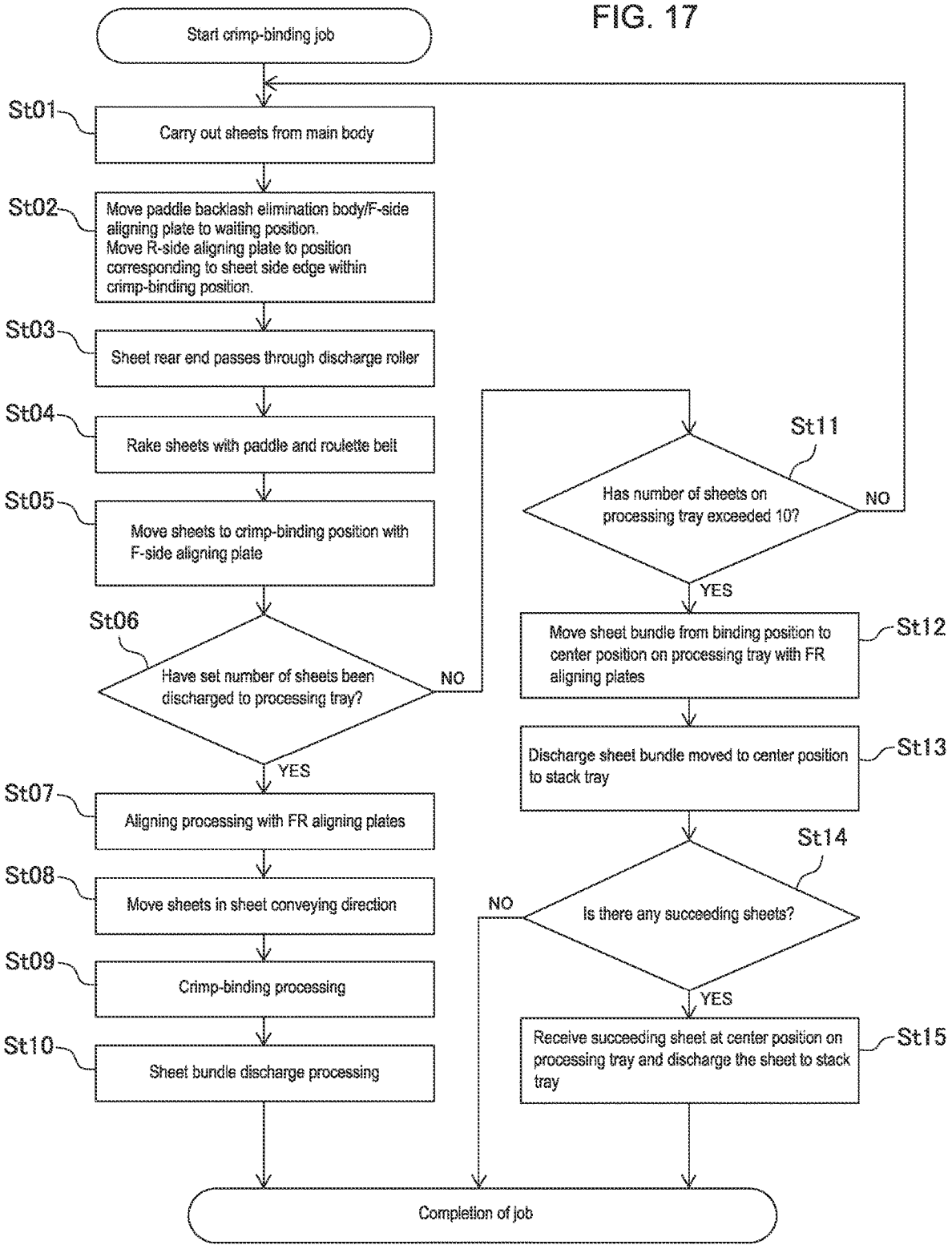
FIG. 17 is a flowchart explaining the operation of an eco-binding job.

The operation of the eco-binding processing will be described according to a flowchart of FIG. 17. For convenience of description, "a paddle" refers to a sheet carry-in unit (paddle rotating body 36 or the like), "a roulette" refers to a raking rotating body 33, "an aligning plate" refers to a side aligning member 45, and "assists" refer to the first and second conveying members 60A and 60B.

Eco-Binding Mode

The following describes details of the operation to be performed in the eco-binding mode.

Description of Eco-Binding Operation

The eco-binding operation will be described according to a flowchart of FIG. 17 and FIGS. 18A to 22D corresponding to the flowchart. Upon receiving a signal indicating the crimp-binding mode having been selected from the image forming unit A, the controller 75 starts a crimp-binding job. Based on a sheet feed start signal from the image forming device main body or a front end detection signal from the sheet senor Se1 (St01), the paddle rotating body 36 and the side aligning units 46F and 46R are positioned at least before a first sheet of a target sheet bundle to be crimp-bound is discharged onto the processing tray 24 (St02). Specifically, the paddle rotating body 36 is positioned at its waiting position, and the side aligning units 46F and 46R are positioned at their waiting positions spaced apart at a distance larger than the width of the sheet being carried in. At this time, the side aligning unit 46R provided on the device rear side is previously set to a position where the sheet bundle is bound by the crimp-binding unit 27, that is, a position where the rear side end edge of the sheet bundle is subjected to the crimp-binding.

Then, the controller 75 lowers the paddle rotating body 36 from the upper waiting position to the lower actuation position at the timing (St03, FIG. 18A) when the sheet rear end passes the sheet discharge roller 32 (St04). In addition, the controller 75 lowers the roulette rotating body 34 from the upper waiting position above the sheet placing surface to the lower actuation position on the sheet placing surface (St04). At this time, both the paddle rotating body 36 and roulette rotating body 34 are rotated in a direction opposite to the sheet discharging direction.

Figure 18A:
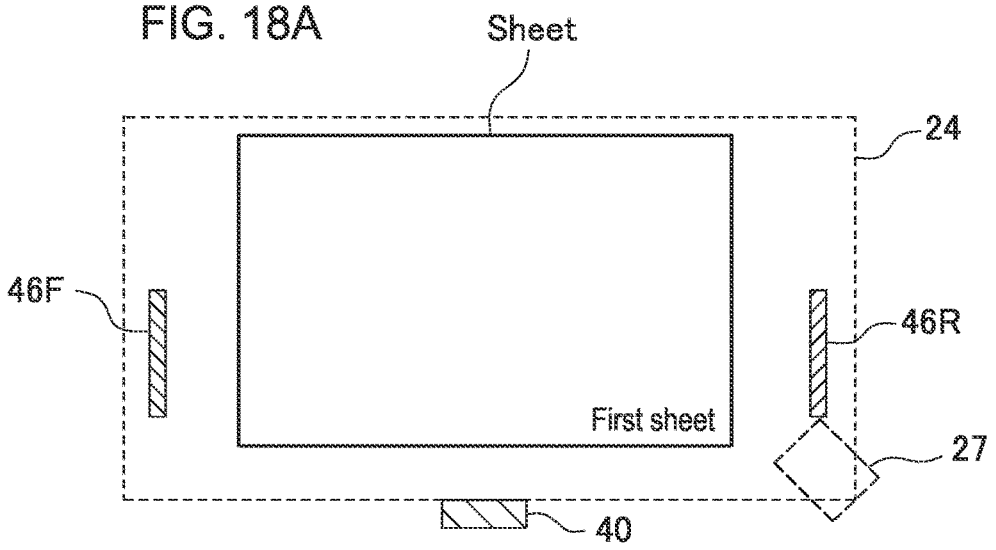
FIGS. 18A to 18C are explanatory views of the eco-binding job.
Figure 18B:
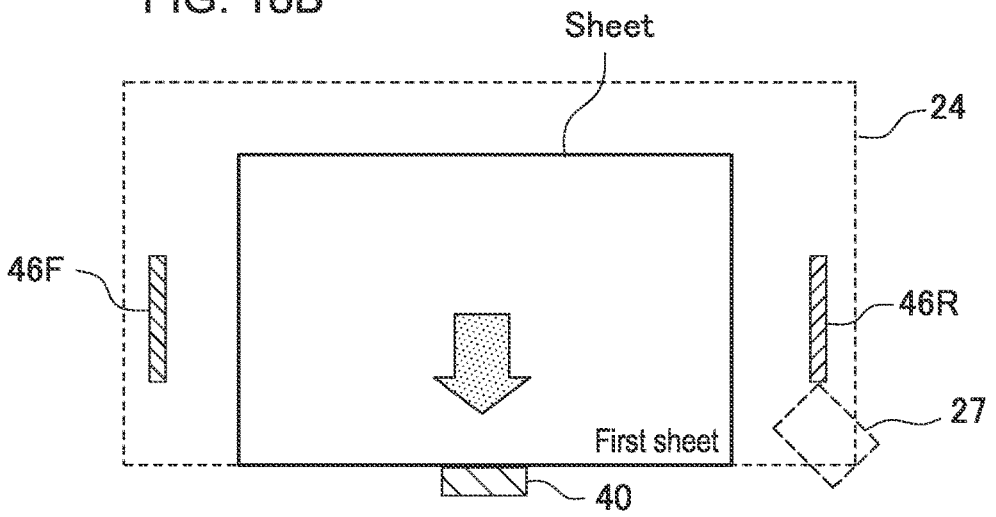
Figure 18C:
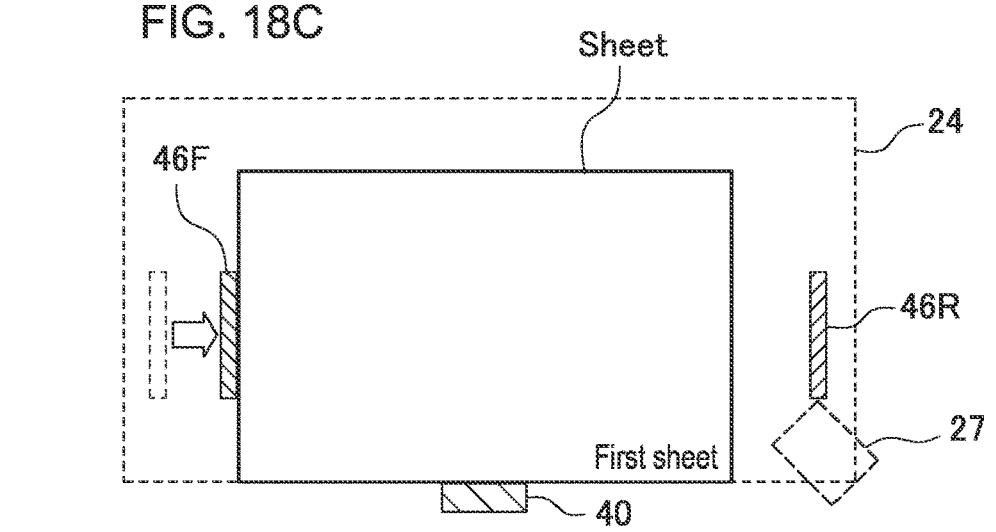

After the elapse of a predetermined period of time (assumed time for the sheet rear end to reach the position of the roulette rotating body 34), the controller 75 lifts the paddle rotating body 36 from the actuation position to the waiting position. Further, after the elapse of a predetermined period of time (assumed time for the sheet front end to reach the rear end regulating member), the controller 75 lifts the roulette rotating body 36 by a small amount. The lifting amount of the paddle rotating body is previously set based on an experimental value to reduce a pressing force against a sheet. As a result, the rear end of the sheet in the sheet conveying direction abuts against the sheet regulating unit 40 (FIG. 18B).

Figure 19A:
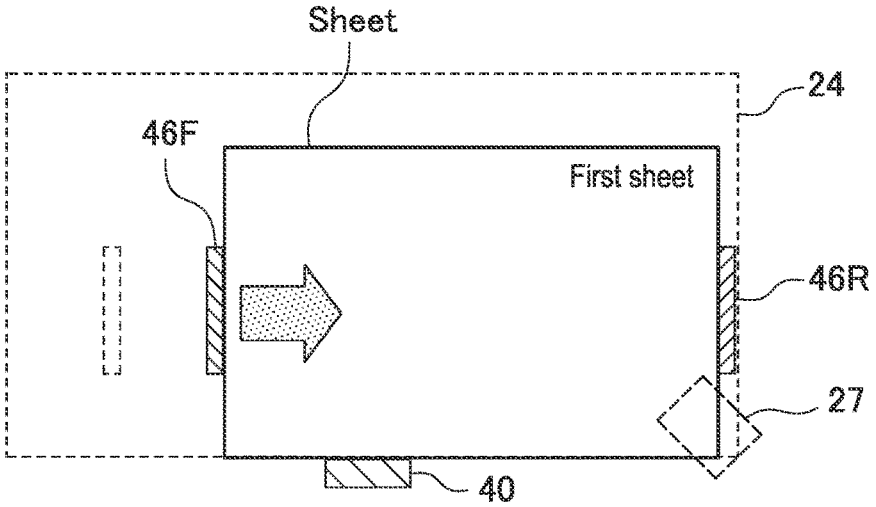
FIGS. 19A to 19C are explanatory views of the eco-binding job.
Figure 19B:
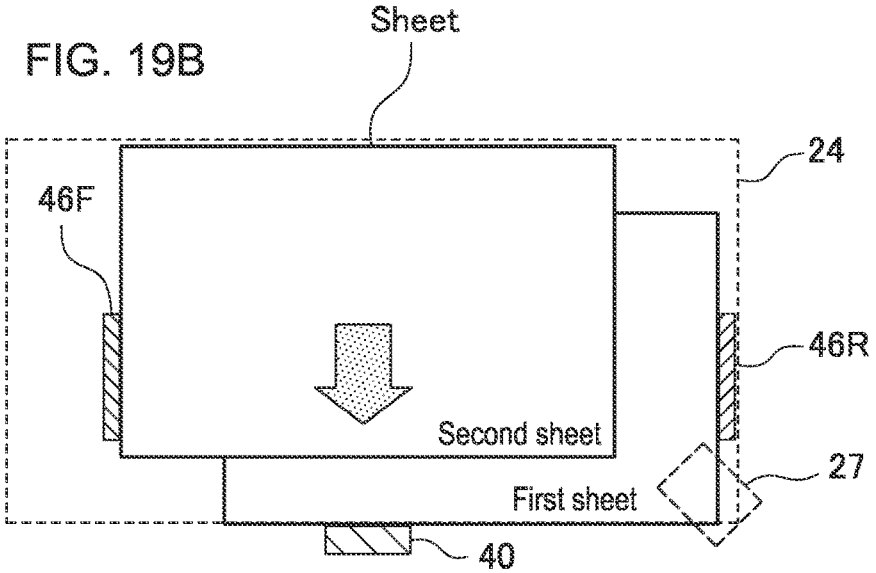
Figure 19C:
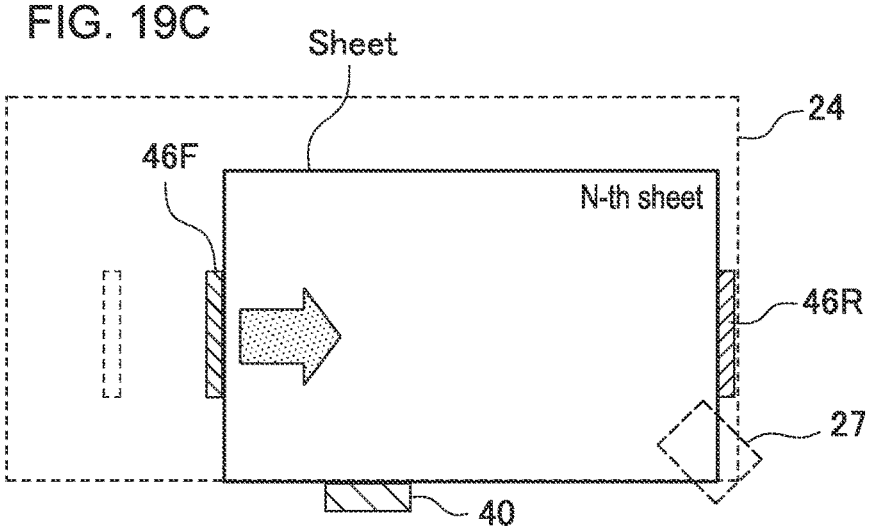

Then, the controller 75 causes the sheet to move to the crimp-binding position Ep on the device rear side by means of the side aligning member 46F (St05). The first sheet constituting the sheet bundle may also be moved to the rear side while being nipped by the pair of side aligning members 46F and 46R; however, in the present embodiment, focusing on productivity, the rear-side side aligning member R is stopped at a position corresponding to the sheet side edge within the crimp-binding position Ep (FIG. 18C) as described above, and the front-side side aligning member 46F is moved toward the rear-side side aligning member 46R to move the sheet (FIG. 19A). For movement of the second and subsequent sheets (n-th sheet: $n \leq 10$), since there has already existed a sheet on the processing tray, the rear-side side aligning member 46R is stopped at a position corresponding to the sheet side edge within the crimp-binding position Ep (FIG. 19B), and the front-side aligning plate is moved toward the rear-side aligning plate to move the sheet every time a sheet is discharged onto the processing tray (FIG. 19C).

The above-mentioned paper guide member 81 is positioned at the retracting position when a sheet is discharged onto the processing tray 24 and is then moved to the guide position when the sheet is moved to the eco-binding position by the side aligning member 46F. This operation is performed for each sheet.

The maximum number of bindable sheets is set to 10 in the crimp-binding device according to the present embodiment, so that the above sheet carry-out and sheet movement to the crimp-binding position are repeated until the set number (10 or less) of sheets to be bound is reached (St06). After the discharge and movement of the first sheet to the crimp-binding position, the front-side side aligning member 46F is once set back to the waiting position. Then, after the next sheet is discharged from the sheet discharge roller 32 and is moved to the sheet regulating unit 40 by the raking operation of the paddle rotating body 36 and roulette rotating body 34, the front-side side aligning member 46F is moved toward the rear-side side aligning member 46R to move the sheet. This operation is performed every time one sheet is discharged (St01 to St06).

Figure 20A:
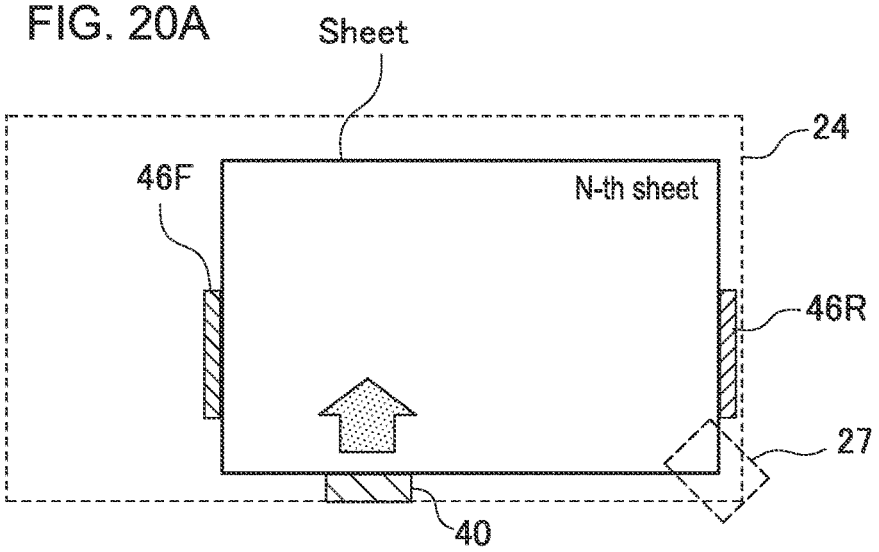
FIGS. 20A to 20C are explanatory views of the eco-binding job.
Figure 20B:
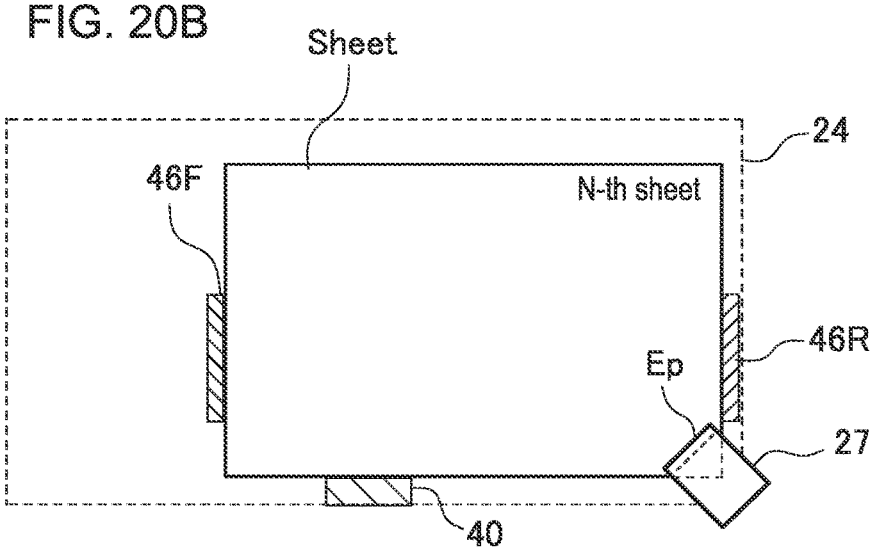
Figure 20C:
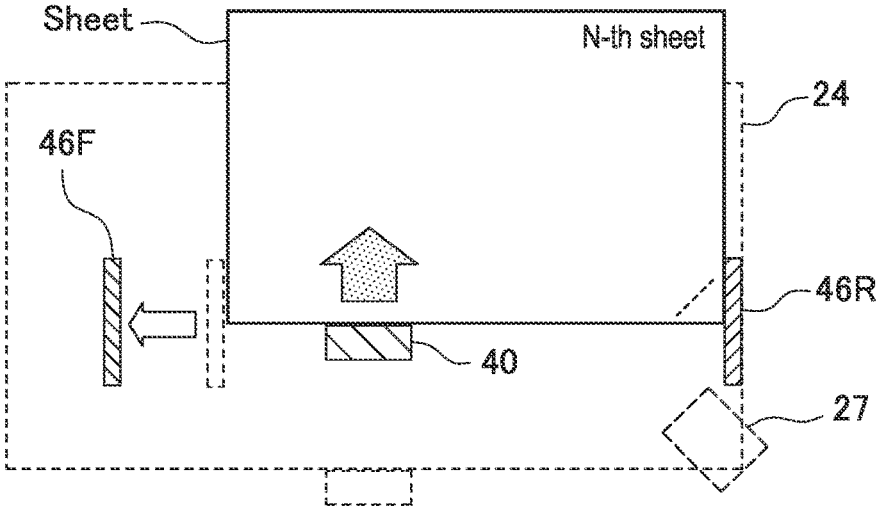

When the number of sheets positioned at the crimp-binding position is 10 or less, widthwise alignment is performed at the crimp-binding position Ep by the side aligning members 46F and 46R (St07), the sheet regulating unit 40 is moved downstream in the sheet conveying direction to be set in position (St08, FIG. 20A), crimp-binding is performed by the crimp-binding unit 27 (ST09, FIG. 20B), and the bound sheet bundle is moved downstream in the sheet conveying direction to complete the sheet discharge operation (St10, FIG. 20C).

Since the maximum number of bindable sheets is set to 10 in the crimp-binding device according to the present embodiment, the above sheet movement to the crimp-binding position is repeatedly performed. Here, when the number of sheets positioned at the crimp-binding position is 10 or less, widthwise alignment is once performed at the crimp-binding position, and then the sheet regulating unit is moved downstream in the sheet conveying direction to be set in position, followed by crimp-binding, and the bound sheet bundle is moved downstream in the sheet conveying direction by the sheet bundle carry-out unit 60 to complete the sheet discharge operation onto the stack tray 25. However, in the course of the above movement of the second and subsequent sheets, the maximum number (10 sheets) of bindable sheets may be exceeded. This may occur, for example, when the number of documents that have been read by the image reading device exceeds 10 sheets since the number of sheets to be bound is yet to be known at the input stage of a job.

A stapling device can cope with such a case. That is, since the number of sheets to be staple-bound is large (50 to 100 sheets) in the stapling device, accumulation of sheets on the processing tray is continued and the sheets are discharged without binding processing. On the other hand, in the case of crimp-binding which can handle a smaller number of sheets (10 sheets in the present embodiment) than the stapling, the binding frontage itself is narrow, so that when the number of sheets exceeds 10, the next (11th) sheet contacts the binding frontage, which may occur a sheet jam.

In the present embodiment, when there is any succeeding sheet in the same job in a state where the number of sheets positioned at the crimp-binding position is 10, a crimp-binding cancel operation to be described later is performed to cancel the crimp-binding to thereby prevent the occurrence of a sheet jam.

In the present embodiment, when there is any succeeding sheet which belongs to the same sheet bundle in a state where 10 sheets are sequentially inserted one by one into the crimp-binding position, a binding cancel operation to discharge the sheet outside the device without performing binding processing on the sheets that have already been at the crimp-binding position. The details of the binding cancel operation will be described below.

When the 11th sheet included in the same bundle is conveyed from the image forming device in a state where the 10 sheets are positioned at the crimp-binding position (FIG. 21A) (St11), the binding cancel operation is performed in response to carry-in of the 11th sheet to the post-processing unit.

Figure 21A:
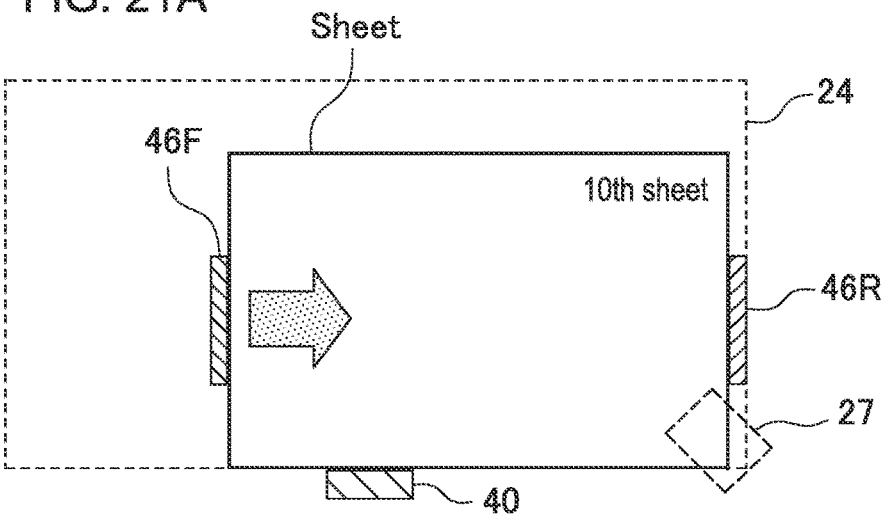
FIGS. 21A to 21C are explanatory views of the eco-binding job.
Figure 21B:
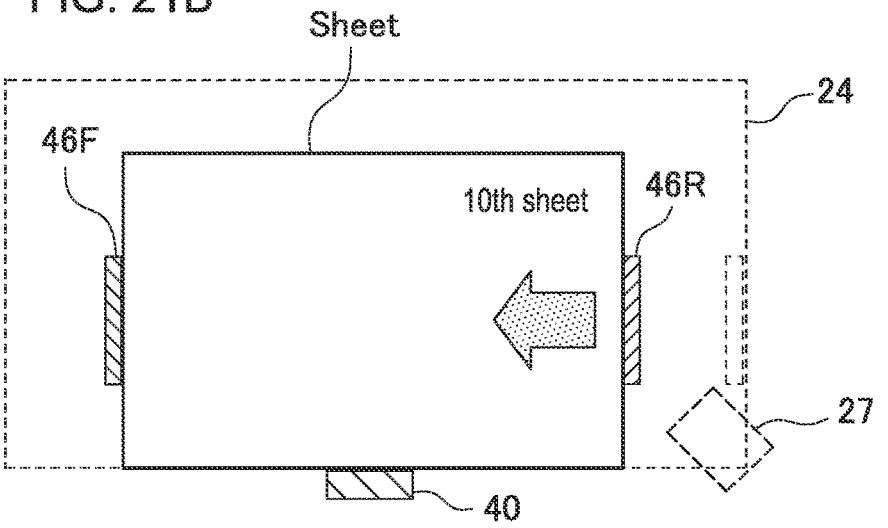
Figure 21C:
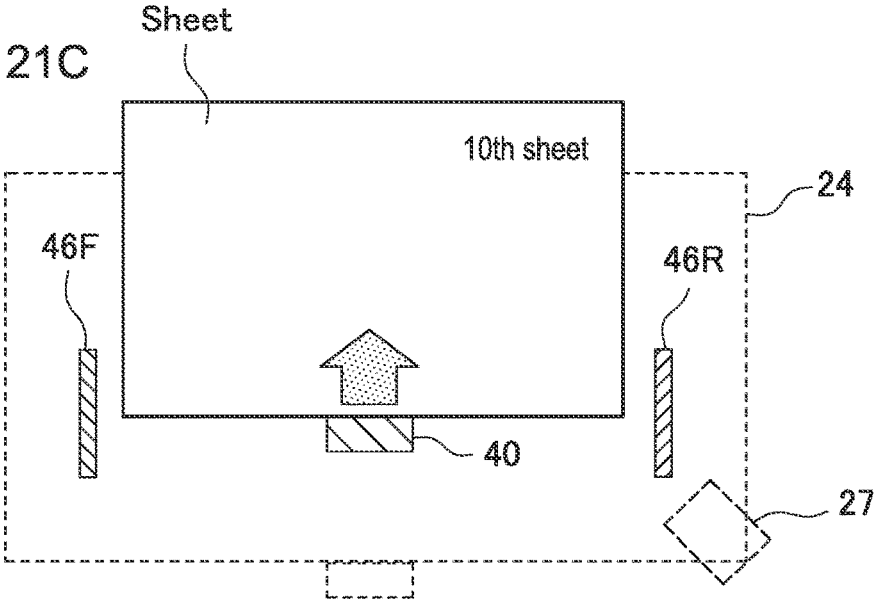

First, the aligning members 46F and 46R are moved to move the 10 sheets positioned at the frontage of the crimp-binding device to the center position of the processing tray, that is, an initial position (discharge position) to which a sheet is discharged (St12, FIG. 21B). Then, the 10 sheets are moved downward in the sheet conveying direction by the regulating unit to thereby complete the discharge operation of the stacked 10 sheets (St13, FIG. 21C).

Figure 22A:
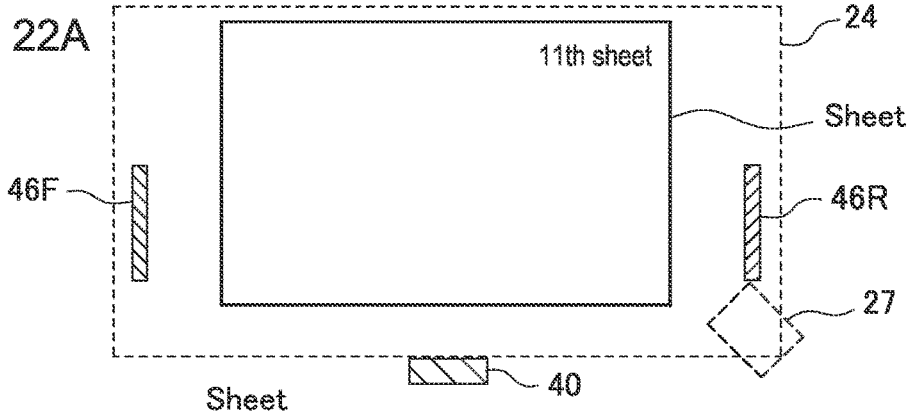
FIGS. 22A to 22D are explanatory views of the eco-binding job.
Figure 22B:
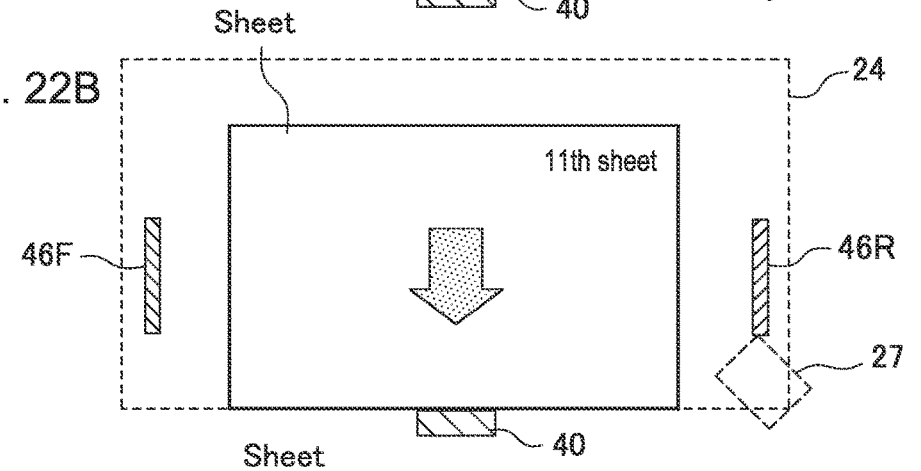
Figure 22C:
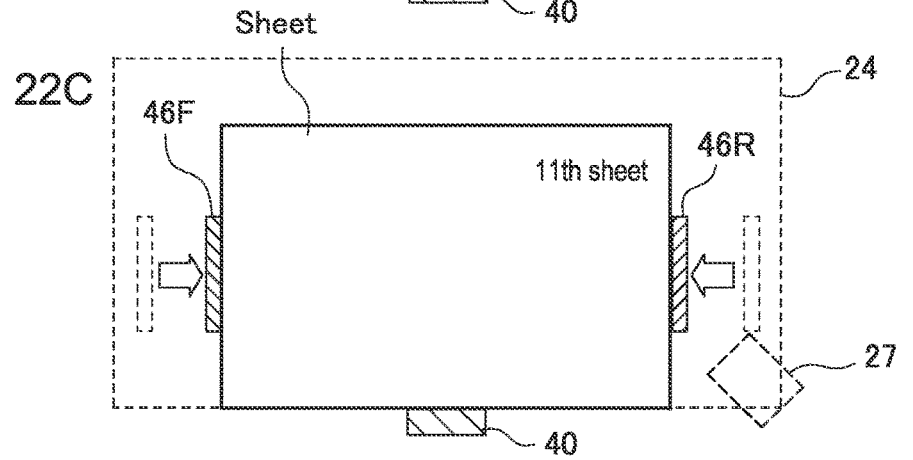
Figure 22D:
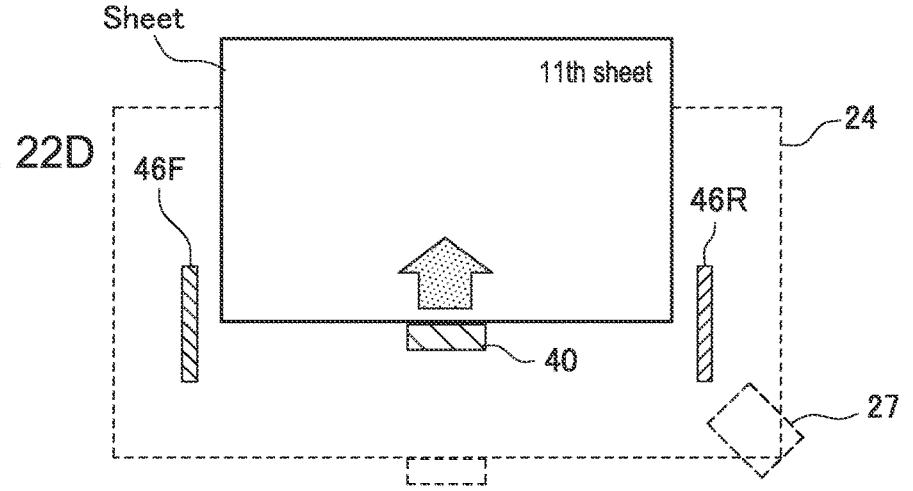

The 11th and subsequent sheets are conveyed in a flag-off state (binding number over flag ON) in terms of the crimp-binding processing, so that when being discharged to the processing tray (FIG. 22A), they are subjected to alignment processing by the regulating unit 40 and side aligning units 46F and 46R every time they each are discharged to the discharge position without shifting to the crimp-binding position (FIG. 22B and FIG. 22C). Then, the resultant sheets are moved downstream in the sheet conveying direction by the regulating member and discharged to the stack tray 25 (St15, FIG. 22D). The discharge operation of the succeeding sheets is performed by the same control as that for a normal straight discharge mode. Thus, it is possible to adopt a method in which a certain number of sheets are once carried in to the processing tray 24 before being discharged to the stack tray 25 and a method in which sheets are not discharged to the processing tray 24 but discharged directly to the stack tray 25. Thereafter, the number of discharged sheets reaches a predetermined number of sheets in the job, this job is completed. The succeeding sheets when the maximum number of bindable sheets is exceeded may be discharged one by one, every two or more, or in units of a bundle.

When the maximum number of bindable sheets is exceeded in one job, any succeeding sheet bundle in the same job is also conveyed in a flag-off state (binding number over flag ON) in terms of the crimp-binding processing. Thus, the sheets belonging to the succeeding sheet bundle are not shifted one by one on the processing tray 24 but carried in to the discharge center position and then discharged as they are to the stack tray 25.

This application is based upon and claims the benefit of priority from prior Japanese Patent Application No. 2020-149773, the entire contents of which are incorporated herein by reference.

The invention claimed is:

1. A sheet crimp-binding device comprising:

a conveying path which guides a sheet in a predetermined conveying direction;

a placing part on which the sheet conveyed along the conveying path is placed;

a stack part provided at a location downstream from the placing part in the sheet conveying direction;

a discharge unit that discharges the sheet from the placing part to the stack part;

a shift unit that moves the sheet placed on a placing position on the placing part in a direction along a sheet surface and perpendicular to the sheet conveying direction;

a crimp-binding unit that applies crimp-binding processing to sheets that have been moved in the direction perpendicular to the sheet conveying direction by the shift unit to a crimp-binding position;

a recognition unit that recognizes count information of a sheet to be fed to the placing part; and a control unit configured to, when the recognition unit recognizes presence of an additional succeeding sheet in a state where a number of sheets that are moved to the crimp-binding position every time one sheet is placed on the placing part reaches a predetermined maximum number of bindable sheets, move the sheets that have been moved to the crimp-binding position by the shift unit to the placing position and then discharge them to the stack part by means of the discharge unit, align the additional succeeding sheet at the placing position by means of the shift unit, and cancel movement of the succeeding sheet conveyed to the placing part to the crimp-binding position by means of the shift unit.

2. The sheet crimp-binding device according to claim 1, wherein when the number of sheets that are positioned at the crimp-binding position is equal to or less than the predetermined maximum number of bindable sheets, the control unit moves the sheet bundle positioned at the crimp-binding position by a predetermined amount in the sheet conveying direction and then applies the crimp-binding processing.

3. The sheet crimp-binding device according to claim 1, wherein a stapler that applies stapling processing to sheets is disposed at a position near the placing position of the placing part, and the crimp-binding unit is disposed, in a direction perpendicular to the sheet conveying direction, more apart from the placing position than the stapler.

4. An image forming system provided with the sheet crimp-binding device as claimed in claim 1.

5. The sheet crimp-binding device according to claim 1, wherein the control unit is configured to discharge the additional succeeding sheet at the placing position to the stack part.

6. A sheet crimp-binding device comprising:

a conveying path which guides a sheet in a predetermined conveying direction;

a placing part which places the sheet discharged from the conveying path on a predetermined discharging position;

a crimp-binding unit that applies crimp-binding processing by pressing a plurality of sheets that has been placed on the discharging position, at a predetermined crimp-binding position different from the discharging position;

a shift unit that moves, perpendicular to the conveying direction, in a width direction along a sheet surface of a sheet placed on the discharging position of the placing part, to thereby move the sheet placed on the discharging position from the discharging position to the crimp-binding position, and to move a sheet that is not applied with the crimp-binding processing after being moved to the crimp-binding position, to the discharging position from the crimp-binding position;

a discharge unit that discharges, from the placing part to a predetermined discharging direction, a plurality of sheets applied with the crimp-binding processing by the crimp-binding unit and the sheet not applied with the crimp-binding processing;

a stack part that is provided at a location downstream from the placing part in the sheet conveying direction, and stacks the sheets discharged from the discharge unit at a predetermined stack position;

a recognition unit that recognizes a number of sheets mounted on the discharging position of the placing part and recognizes presence or absence of a succeeding sheet to be discharged from now onto the discharging position of the placing part; and a control unit configured to, in a state that the shift unit moves the sheets mounted on the discharging position of the placing part to the crimp-binding position and the number of sheets mounted on the discharging position of the placing part that the recognition unit recognizes reaches a maximum number of sheets that the crimp-binding unit can apply crimp-binding, when the recognition unit recognizes presence of an additional succeeding sheet, control the crimp-binding unit, the shift unit and the discharge unit such that after the shift unit moves the maximum number of sheets at the crimp-binding position to the discharging position without applying the crimp-binding by the crimp-binding unit, the discharge unit starts to discharge the maximum number of sheets to the stack position, and the discharge unit discharges the succeeding sheet to the stack position without moving the succeeding sheet to the crimp-binding position by the shift unit.

7. The sheet crimp-binding device according to claim 6, wherein the control unit controls the crimp-binding unit, the shift unit and the discharge unit such that before the maximum number of sheets moved from the crimp-binding position to the discharging position by the shift unit is discharged to the stack position by the discharge unit without applying the crimp-binding by the crimp-binding unit after being moved to the crimp-binding position, the shift unit aligns the maximum number of sheets so that a position of the maximum number of sheets moved to the discharging position comes to a same position with the stack position in the width direction.

8. The sheet crimp-binding device according to claim 7, wherein the control unit controls the crimp-binding unit, the shift and the discharge unit such that before the succeeding sheet is discharged to the stack position by the discharge unit, the shift unit aligns the succeeding sheet so that a position of the succeeding sheet comes to a same position with the stack position in the width direction.

9. An image forming system provided with the sheet crimp-binding device as claimed in claim 8.

* * * * *